US012491428B1

(12) United States Patent
Curley

(10) Patent No.: US 12,491,428 B1
(45) **Date of Patent: *Dec. 9, 2025**

(54) LOW PROFILE POKER ROOM SHUFFLER

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/950,107

(22) Filed: Nov. 17, 2024

Related U.S. Application Data

(63) Continuation-in-part of application No. 18/737,984, filed on Jun. 8, 2024, now Pat. No. 12,179,090.

(51) Int. Cl.
*A63F 1/12* (2006.01)

(52) U.S. Cl.
CPC ..... *A63F 1/12* (2013.01)

(58) Field of Classification Search
CPC ..... A63F 1/12; A63F 1/14
See application file for complete search history.

(56) References Cited

U.S. PATENT DOCUMENTS

| | | | | |
|---|---|---|---|---|
| 1,885,276 | A | 11/1932 | McKay | |
| 3,260,520 | A | 7/1966 | Sugden | |
| 3,771,783 | A | 11/1973 | McInerny | |
| 4,586,712 | A | 5/1986 | Lorber | |
| 4,659,082 | A | 4/1987 | Greenberg | |
| 4,770,421 | A | 9/1988 | Hoffman | |
| 5,989,122 | A | 11/1999 | Roblejo | |
| 6,149,154 | A | 11/2000 | Grauzer | |
| 6,267,248 | B1 | 7/2001 | Johnson | |
| 7,500,672 | B2 | 3/2009 | Ho | |
| 7,753,374 | B2 | 7/2010 | Ho | |
| 7,900,924 | B2 | 3/2011 | Ho | |
| 8,342,525 | B2 | 1/2013 | Scheper | |
| 8,353,513 | B2 | 1/2013 | Swanson | |
| 8,480,088 | B2 * | 7/2013 | Toyama | A63F 1/12 273/149 R |
| 8,544,848 | B2 | 10/2013 | Blaha | |
| 8,590,896 | B2 | 11/2013 | Krenn | |
| 8,931,779 | B2 | 1/2015 | Grauzer | |
| 9,126,103 | B2 | 9/2015 | Krenn | |
| 9,623,317 | B2 | 4/2017 | Scheper | |
| 9,717,979 | B2 | 8/2017 | Grauzer | |
| 9,922,502 | B2 | 3/2018 | Grauzer | |
| 10,226,686 | B2 | 3/2019 | Scheper | |
| 10,864,431 | B2 | 12/2020 | Stasson | |
| 11,376,489 | B2 | 7/2022 | Scheper | |

(Continued)

*Primary Examiner* — Michael D Dennis
(74) *Attorney, Agent, or Firm* — Chris Tanner; FYPA PLLC

(57) ABSTRACT

The invention herein describes a card handling device used for creating pre-formed hands for use in casino poker games whereupon the device may be programmed to accommodate a number of different game variations, and a number of players. The device comprises an unshuffled card input portal, a shuffled card discharge portal, and a radial card receiver whose operation utilizes centrifugal force. The exploitation of centrifugal force allows the device to be operated without the need for the motorized pusher mechanisms which are prevalent in the prior art, thus creating a device that is more compact and requires less manufacturing cost. The device is designed to be embedded unobtrusively in a poker table or adjacent stand such that the entire bezel surface resides at an elevation lower than the poker chip tray.

15 Claims, 20 Drawing Sheets

(56) References Cited

U.S. PATENT DOCUMENTS

| | | | | |
|---|---|---|---|---|
| 2002/0017481 | A1* | 2/2002 | Johnson | B07C 5/34<br>463/16 |
| 2015/0238848 | A1* | 8/2015 | Kuhn | A63F 1/12<br>273/149 R |
| 2020/0171375 | A1 | 6/2020 | Litman | |
| 2024/0009547 | A1 | 1/2024 | Oeding | |

* cited by examiner

LOW PROFILE POKER ROOM SHUFFLER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a single deck of playing cards in order to form "hands" for use in various types of poker games. These shuffler types are called "hand forming" shufflers in the art because they sequentially dispense multiple groups of play-ready cards to a delivery tray, whereupon a casino dealer issues one shuffled hand to each player at the initiation of a poker game. The groups of play-ready cards are herein referred to as "substacks".

CO-PENDING APPLICATION

Other various methods and device embodiments for implementing hand-forming shuffling machines are disclosed in co-pending U.S. patent application Ser. No. 18/737,984 which was filed on Jun. 8, 2024 and is incorporated herein by reference in entirety.

BACKGROUND

Stud poker games such as Let it Ride®, Three-Card Poker®, or Caribbean Stud® are major attractions in casino poker rooms because they are relatively easy to play and allow wagering to various degrees of risk. A single deck of 52 playing cards is used in these games, which must be periodically shuffled to effect randomness of the rank and suit of the individual cards within the deck. Each poker game is initiated by delivering a shuffled (randomized) hand of playing cards to each game participant. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

"Hand-forming" shufflers quickly randomize card decks and sort them into shuffled substacks within compartments which reside within the device. Upon dealer request, each substack is delivered to an exit portal where a dealer may issue that hand to a player. The hand-forming shufflers are programmable such that the number of cards in each substack may be adjusted for individual card games, and for the number of players. For example, various forms of five-card stud poker will be initiated with hands of 5 cards, while games such as Three-Card Poker® are played with hands of only three cards.

FIG. 1 illustrates an early "hand-forming" playing card shuffler that was described in a 1932 patent granted to R. C. Mckay and issued as U.S. Pat. No. 1,885,276 (Mckay '276). Groups of individual playing cards are accumulated into substacks in four compartments which are configured radially in a rotating carrier. FIG. 1 is reproduced from the Mckay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 thru 1028 for accumulating substacks of randomly selected cards. The receiver 1024 rotates about pivot 1032 to one of four randomly chosen radial positions. A deck of cards is placed into the magazine 1001 which utilizes rubber tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 thru 1028.

Mckay '276 appears to have pioneered the concept of "shuffling" cards by distributing individual cards randomly into a myriad of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is known in the industry as the "Lorber Design" and was taught by U.S. Pat. No. 4,586,712 (Lorber '712), which was granted in 1986. This classic configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card.

As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an "ejecting device" 2066. Driven rollers 2054 and 2055 move the individual cards into a newly created stack within the space 2068. The stack of cards within discharge portal 2068 has thus been arranged randomly (shuffled).

Rather than arranging the card storage compartments within a circular carousel, other early shufflers utilized compartments configured in a vertical stack. 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly-arranged storage exemplified by drums and carousels.

A more recent "hand-forming" shuffler is taught by U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha is used as a hand forming shuffler.

Referring to FIG. 3B, unshuffled cards 313 residing in an unshuffled card station 310 (upper left) are transported by feed rollers 314, 315, 318 and 319 into compartments 369 of the "rotatably held drum" 302. The rollers 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card is pushed sufficiently into the friction rollers 340 and 345, those rollers move the cards to the "card storage means" 342, as driven by motor 341. Blaha '460 uses two motors to insert each card into the drum, and another two motors to extract the substacks.

The Blaha '460 drum must rotate through several rotation cycles to accumulate substacks, and then must rotate again to disgorge those substacks. While rotating, the substacks of playing cards in each compartment of the Blaha '460 carousel are subjected to centrifugal forces which try to propel the cards outwardly from their compartments during each excursion. The magnitude of the centrifugal forces is dependent upon the acceleration used to rotate the drum 302.

Blaha teaches that the substacks are retained in opposition to the centrifugal force by clamping the stacks with springs which are provided within each compartment of the carousel. FIG. 4 shows the leaf springs 351 and 353 as reproduced from the '460 patent figures. The disclosure explains that the "springs insure the clamping of the card(s) inserted into the respective compartments" (Blaha '460 4:13-14).

The acceleration used for rotation of the Blaha '460 drum is limited by the clamping force of the springs. FIG. 5 illustrates the physics of the clamping force. This vector diagram explains that the retaining spring 501 must exert sufficient force against the face of the cards to counteract the centrifugal force. Referring to FIG. 5, a card substack 5005 is shown resting on the floor 5007 of a compartment of a carousel that rotates about axis 5008. The arrow 5010 represents the angular acceleration which imposes a centrifugal force $F_C$ upon the card substack 5005. A resistance force $F_R$ must be created by the spring 5001 to counteract the centrifugal force and prevent the card stack from flying out of the compartment. The spring acts upon a bearing pad 5003 which bears against the surface of the stack. The resistance force is given by:

$$F_R=\mu N$$

where: μ is the friction coefficient between the bearing pad and the cards

N=normal force imposed by the spring which is $F_S$

Thus, $$F_R=\mu F_S$$

For equilibrium, the resisting force $F_R$ must at least balance the centrifugal force $F_C$:

$$F_C=F_R=\mu F_S$$

Since playing cards are intentionally designed to have slippery surfaces, the friction coefficient between cards in a stack is relatively small. This small friction coefficient exacerbates the clamping friction problem. As seen by the clamping equation, a relatively large spring force must be used to counteract centrifugal force when the friction coefficient is small. Conversely, the spring force is limited by the force required to push the cards into the substack during loading of the compartment.

The magnitude of the retaining spring clamping force requires that the Blaha device uses a first motorized "pusher" mechanism to insert cards into the compartments and a second motorized pusher mechanism to extract the cards from the compartments. These pusher mechanisms, which push against the edge of each card, are required to overcome the clamping forces imposed by the retaining springs in each compartment as each card is slid into the pre-existing stack. One of ordinary skill recognizes that those two motorized "pusher" mechanisms would not be necessary if the substacks were held loosely in each compartment of the Blaha '460 carousel and retained in the direction of the centrifugal force.

The response time of the Blaha shuffler is also limited by its own carousel configuration. The carousel must rotate approximately 180 degrees for moving any card from the input portal to the output portal. Additionally, the rotational acceleration is limited by the clamping force able to be exerted upon the uppermost card in each stack by the retaining springs. The relation between clamping force and rotational acceleration is thus a design compromise which places an upper limit on carousel acceleration. As will be seen herein, centrifugal force can be advantageously utilized in a card shuffler, rather than being problematic as in the Blaha configuration.

U.S. Pat. No. 6,149,154 was granted to Attila Grauzer et al in 2000 (Grauzer '154) and describes another "hand-forming" shuffler where the carousel compartments are unwound into the form of a linear elevator. The elevator consists of card accumulation compartments which are moved linearly rather than rotationally. FIG. 6 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are randomly inserted into slots of the elevator at one station, and thereafter randomly pushed from slots at another station. Cards cannot be moved directly from the input portal to the discharge portal.

Referring to FIG. 6, Grauzer '154 teaches an elevator with nine compartments called a "rack assembly" which traverses up and down in direction of arrow 884. Unshuffled card decks are placed into the unshuffled card receiver 826 against the surface 870 of a moveable block 868, and individually propelled in direction of arrow 882 by motorized rollers 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. A microcontroller counts the number of cards inserted into each randomly chosen compartment. When a given compartment reaches the capacity of cards required for a hand, no more cards are entered into that compartment, and the compartment is considered ready for disgorgement.

When enough compartments are filled to the hand capacity needed for the number of players, the shuffler is then ready to disgorge substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only nine (9) compartments are required for proper randomization in a hand forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 7 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 allowing the substack to fall by gravity into the hand receiving platform 836. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. (Grauzer '154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 7. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. (Grauzer '154 8:66-67, 9:1-10)

The oversized compartment 894 shown in FIG. 7 is required to collect the unused cards from the unshuffled card receiver. The unused cards must be temporarily stored in the rack assembly because there is no direct path from the unshuffled card receiver to the hand receiving platform.

FIG. 8 is excerpted from US patent Application US2020/0171375 A1 which was filed in December 2018 by inventor Mark Alan Litman (Litman '375). The Litman '375 disclosure teaches that the device disclosed in FIG. 7 may be embedded within a housing or table such that the uppermost casing surface 940 resides flush with the table surface. An elevator 930 is described for receiving shuffled cards. The elevator appears to be functionally equivalent to a container for temporarily storing stacks of shuffled cards. In one embodiment, the elevator 930 is removed from the device manually using a handle 918. In another embodiment, undisclosed mechanical means are used to lift the elevator housing. The disclosure explains;

> FIG. [8] shows a manually lifted elevator [930]. (Litman '375 @ [0046]) There may be gear drives, friction wheels, chain gears and the like (not shown) adjacent the sides of the elevator to raise the elevator if that is preferred to a manual lift. (Litman '375 @ [0048])

By embedding the shuffling device of FIG. 7 within a table, Litman '375 teaches that the cards located at the base of the elevator 924 are not accessible to the device operator, with the consequence that hands formed by the shuffler cannot be sequentially delivered to the players as they are formed. The disclosure fails to teach any mechanism for sequentially moving individual substacks of cards to a delivery tray that is accessible by the device operator.

One goal of the low profile poker room shuffler described herein is to introduce a more competitive hand-forming shuffler than those which are referenced in the prior art, by achieving discernable manufacturing cost reductions. The card handling device within this disclosure achieves these manufacturing cost reduction goals by eliminating the need for motorized pusher mechanisms and reducing the number of required compartments, thus achieving a hand-forming device that requires less parts, is more compact and is more economical to manufacture than the referenced prior art.

A second goal is to achieve a low profile shuffling device which can reside unobtrusively on a poker table in a convenient location adjacent to the poker chip tray. The bezel portion of the device herein achieves this goal by extending no more than one inch above the table surface; an attribute that is achieved by positioning the shuffled card delivery tray at an elevation which is slightly below the table surface.

The device herein advantageously utilizes centrifugal force to retain and align the card substacks in radially-configured nests, thus eliminating the need for clamping devices and motorized pusher mechanisms, and allowing faster rotational excursions (higher acceleration) during the randomized distribution of cards from the input portal to the temporary storage nests. The device described herein also allows cards to be delivered to a slot-less elevator using centrifugal force and to thereafter be moved to the delivery tray utilizing a unique stripper mechanism.

The unique features, compact silhouette, and cost efficiency advantages of the low profile poker room shuffler will become better understood with reference to the descriptions, drawings and claims which are presented below.

DETAILED DESCRIPTION

Figure 9:
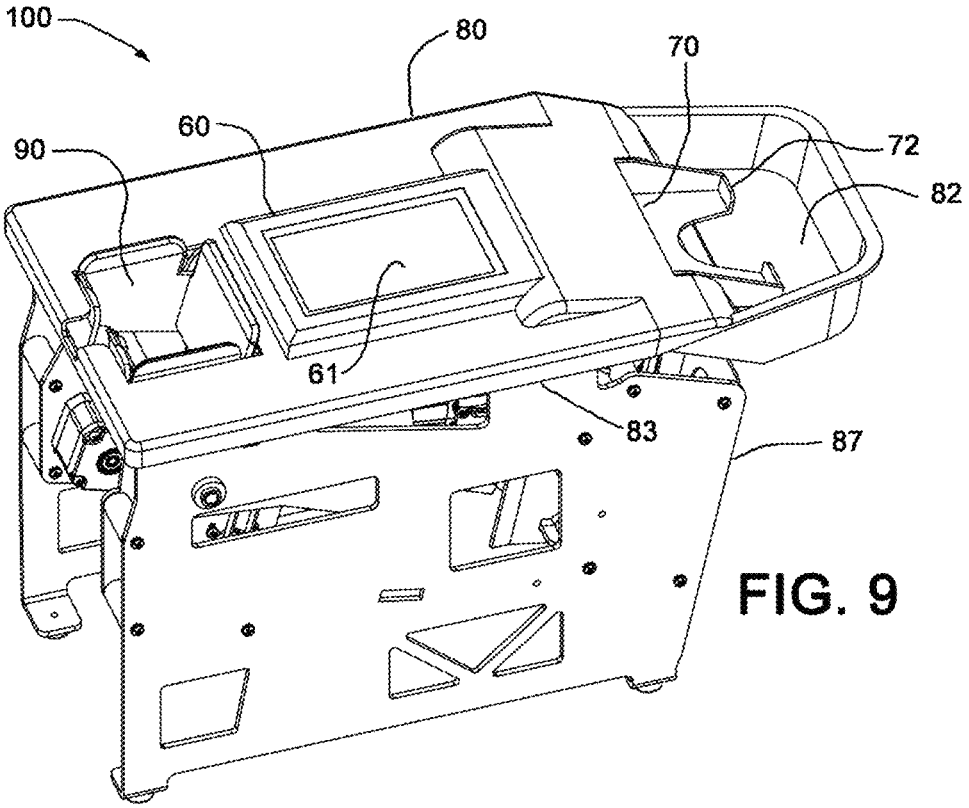
FIG. 9 is a perspective view of the preferred embodiment of the present invention.
Figure 10:
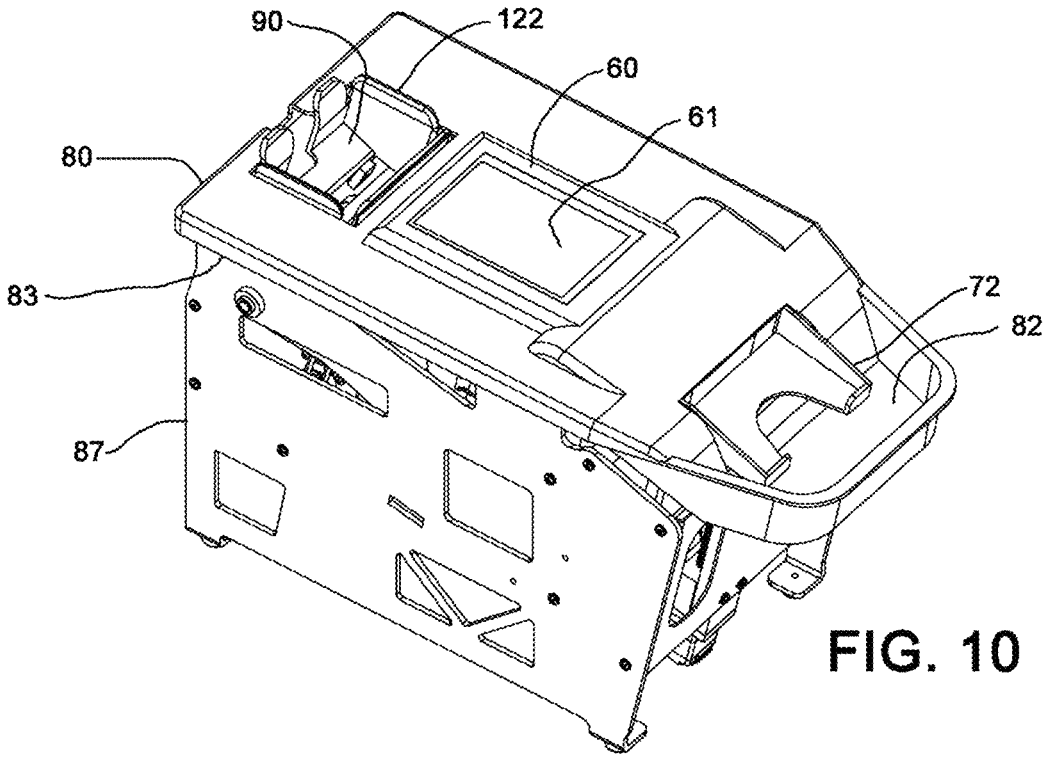
FIG. 10 is an alternate perspective view of the preferred embodiment of the present invention.

FIG. 9 and FIG. 10 illustrate a preferred embodiment of the card handling device disclosed herein. The card handling device 100 possesses an injection molded bezel 80 and a control panel 60 having a touch screen 61 which is positioned conveniently for a casino dealer on the exterior of the bezel. The device is structurally supported by a pair of side frames 87 and including a bezel 80. At least one microcontroller (not shown) controls the operation of the device, including operation of the touch screen. Touch screen 61 is a small 5-inch touchscreen that is used to program the device for various poker games. For size reference, a 5-inch touchscreen is slightly smaller than the smaller touchscreens used in today's mobile phones. Prior to each game, the dealer will utilize the touch screen 61 to program the device to produce the required number of cards in each hand as required by various forms of poker. Additionally, the dealer will program the device to issue N hands, where N is the number hands needed for the game. The touchscreen will also indicate possible malfunctions and security issues to the dealer. For example, the microcontroller counts the number of cards sorted in each deck and will issue a warning on the touch panel if that number is unexpected, as for example due to player or dealer cheating.

Input portal 90 is designed to receive and hold a deck of unshuffled cards. Upon dealer command, those cards are transported individually into a randomizing mechanism which possesses multiple nests, whereupon each nest is randomly filled with one substack (hand) of cards. The microcontroller utilizes a subroutine called a "random number generator" to generate a random address for selecting one of the eight nests for inserting each card as it is moved from the unshuffled card input portal 90. An indicator on the touch panel notifies the dealer when the nests are ready for distribution to the players. Thereafter, the dealer commands the device to sequentially deliver shuffled (randomized) substacks to the delivery tray 72. The sequence of steps for delivering each shuffled substack (hand) to the delivery tray is referred to herein as the "disgorgement cycle".

A card delivery tray 72 is suspended within a cavity 82 which forms a shuffled card discharge portal within the bezel 80. Substacks which are formed within the device are delivered one substack at a time sequentially to the delivery tray 72. In one embodiment, the device will automatically deliver a new substack (hand) to the delivery tray each time that a previous substack (hand) is removed. In another embodiment, the device operator utilizes the touch screen to request delivery of the next substack.

The device is designed to be embedded within a casino table surface or stand and possesses a bezel mounting surface indicated by surface 83 which functions as the device mounting surface. When embedded, only the bezel 80 is visible above the table surface and no portion of the device extends more than one inch above the table surface. The resulting device silhouette is lower than the height of conventional poker chip trays, thus assuring that the device is an unobtrusive occupant of the casino table surface. The low silhouette is achieved by configuring the delivery tray to reside at a height slightly below the table surface.

Figure 11:
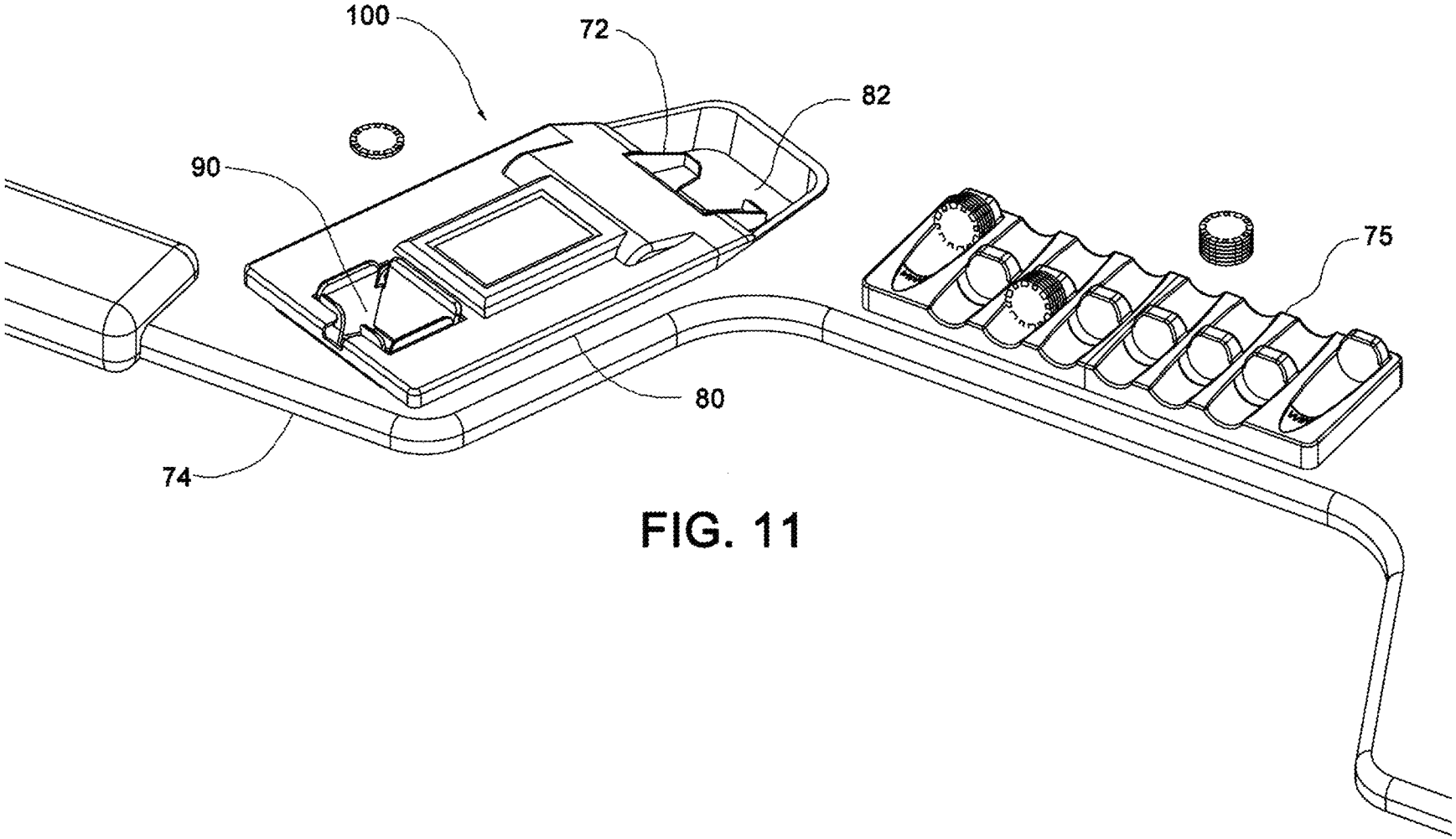
FIG. 11 is a perspective view of the preferred embodiment of the present invention as it would appear in a poker room when embedded within a poker table.

FIG. 11 illustrates a preferred embodiment of the card handling device 100 as it would appear embedded within a poker table in the poker room of a casino. This illustration depicts a common type of casino poker table 74 having a recessed opening in which the game host stands while overseeing the game. The device 100 is embedded conveniently withing the operator's reach and unobtrusively resides adjacent to the poker chip tray 75. Shuffled substacks are delivered to the delivery tray 72 which resides slightly below the table surface within the shuffled car discharge portal 82. The low profile allows the operator to easily access the touch screen and all of the player positions without concern for avoiding the card handling device.

Figure 12:
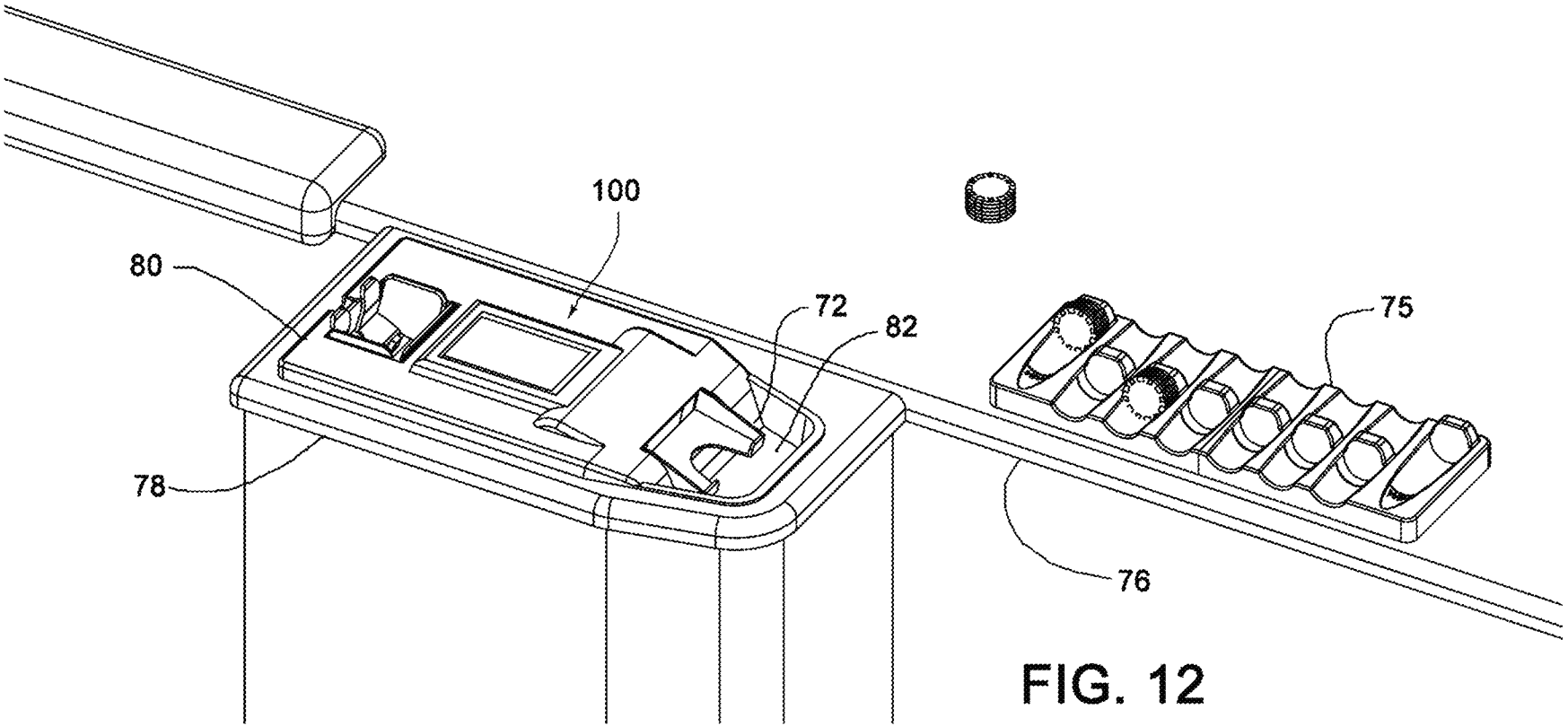
FIG. 12 is a perspective view of the preferred embodiment of the present invention as it would appear in a poker room when embedded within a stand adjacent to the edge of a poker table.

Card handling device 100 is mounted upon a stand 78 which resides along the edge of a poker table 76 in FIG. 12. The top surface of the stand is flush with the table surface while the delivery tray 72 resides slightly below the table surface within the recessed discharge portal 82. The use of a mounting stand adjacent to the table alleviates the need for cutting out a recess in the casino table.

Figure 13:
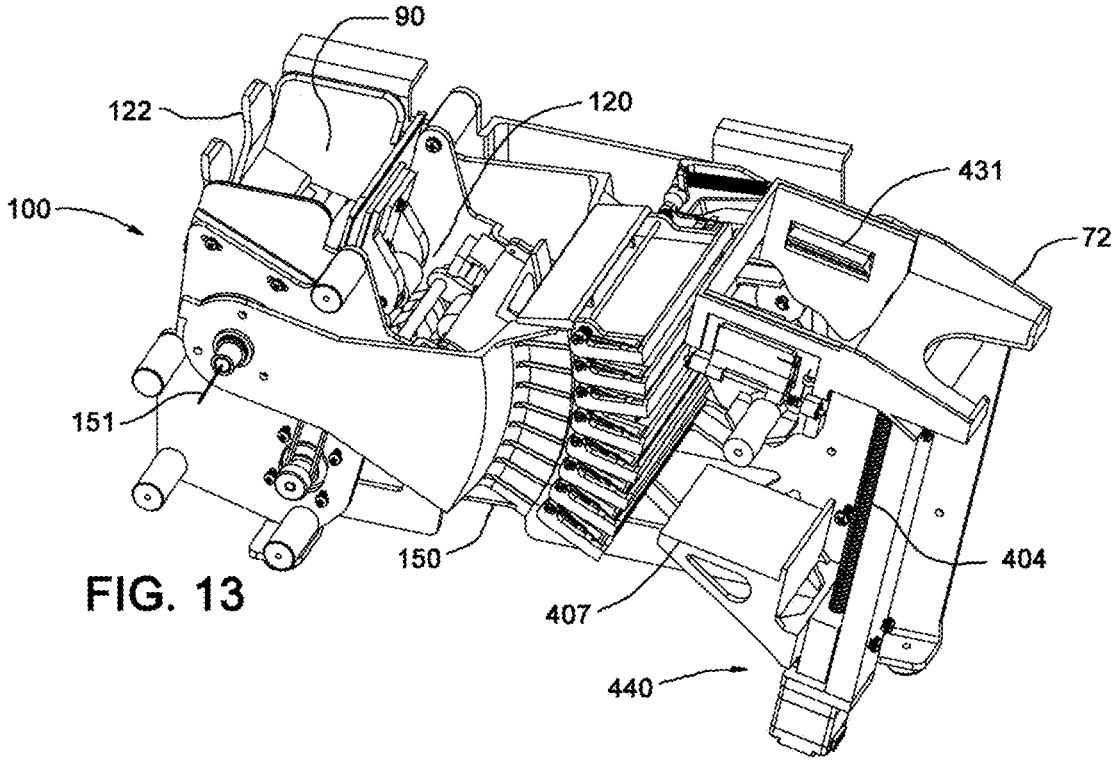
FIG. 13 is a perspective view of the preferred embodiment with its bezel removed.
Figure 14:
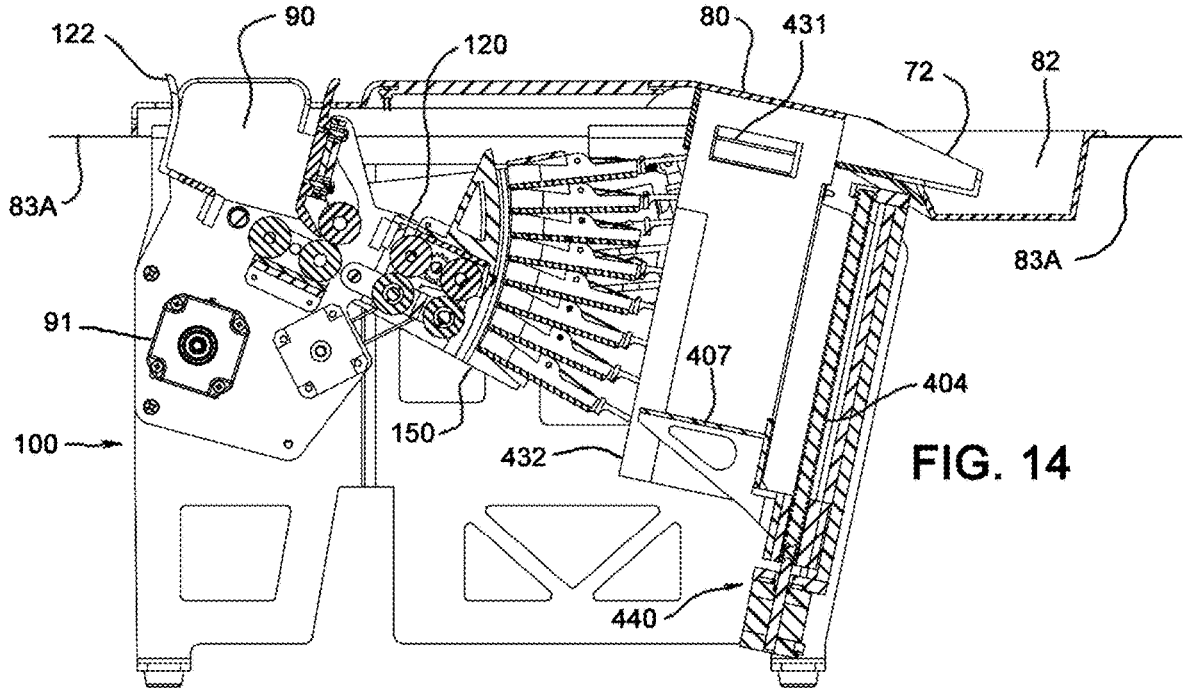
FIG. 14 is a side elevation section view of the preferred embodiment illustrating the internal card movement paths.

An overall view of the internal mechanisms of the card handling device is shown in FIG. 13 where the bezel 80 and the nearest side frame 87 are not shown for the purpose of illustration. FIG. 14 is a side elevation section view showing the same major assemblies. There are three major subassemblies shown in these two figures, including the card transport 120, the radial receiver 150 and the elevator assembly 440. Briefly, feed rolls within the card transport 120 move individual cards from the unshuffled card tray 122 individually into one of eight randomly selected nests within the radial receiver 150, which rotates about axis 151. When the nests have accumulated sufficient number of cards to form a hand, the radial receiver 150 is rotated to discharge the contents of each nest (substack) onto the elevator carriage 407. The substacks are thereafter each raised by the elevator lead screw 404 to a pair of support pawls 431 whereupon the cards are stripped from the elevator carriage 407 and slide into the delivery tray 72. The line 83A in FIG. 14 indicates the mounting surface of card handling device 100 where it can be observed that the delivery tray 72 resides within the discharge portal 82 at an elevation lower than the device mounting surface 83A.

Figure 15:
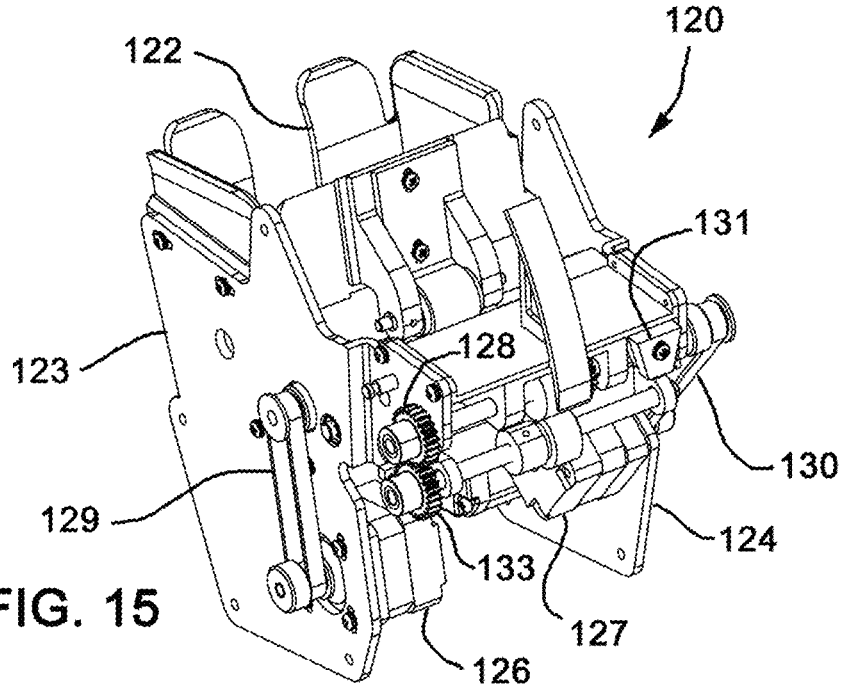
FIG. 15 is a perspective view of the card transport of the preferred embodiment when isolated from the device.

An isometric view of the card transport assembly 120 is shown in FIG. 15. Individual cards are moved from the unshuffled card tray 122 and into the radial receiver 150 by two motors. Motor 126 rotates a set of stripper rolls via timing belt 129 which removes one card at a time from the unshuffled stack. Motor 127 rotates a set of flick rolls via timing belt 130 which accelerate each card into the nests within the radial receiver 150.

Figure 16:
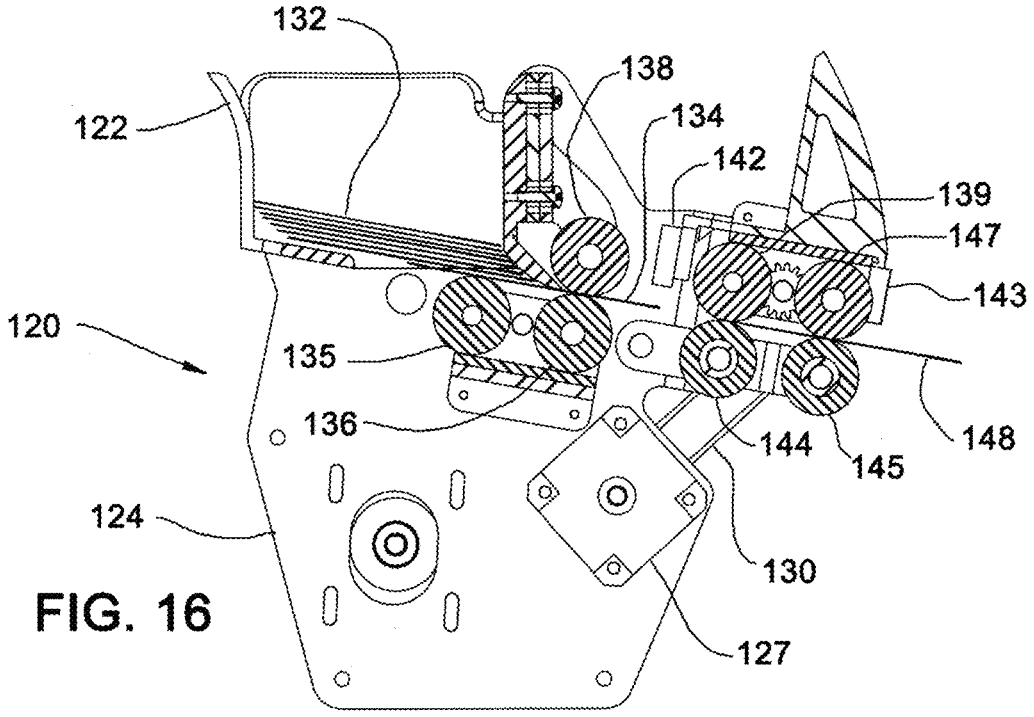
FIG. 16 is a side elevation section view of the card transport of FIG. 15.

FIG. 16 is a section view of the card transport 120 which shows a series of rubber covered transport rolls which illustrate the functionality of the two motors 126 and 127. A stack of cards 132 is shown in the unshuffled card tray 122 where the stack is partially supported by strip roll 135. Motor 126 rotates strip rolls 135, 136 and 138 to "strip" individual cards from the bottom of stack 132 and transports each card until its edge is detected by optical sensor 142. If there exists a second card 148 ahead of card 134, then the strip motor temporarily ceases motion of card 134. The "card path" is defined as the axis defined by an imaginary line along the surfaces of cards 134 and 148.

The optical sensor 143 is utilized to detect the leading and trailing edge of card 148 which is engaged in the forward set of four rolls which are referred to as the "release rolls" 144, 145, 139 and 147. If the trailing card 134 is stopped, then motor 127 will move the leading card 148 with rapid acceleration into the nests of the radial receiver 150. When the trailing edge of card 148 is detected by optical sensor 143, both motors will activate to feed card 134 forward to the release rolls 139, 147, 144 and 145. Additionally, optical sensor 143 is used by the microcontroller to count the cards being inserted into each nest.

The microcontroller keeps track of the cumulative card count in each nest, and therefore "knows" when that nest is "ready". The definition of a "ready" nest is a nest that has accumulated the correct number of cards that correspond to the size of the hand that is programmed for the game underway. When a nest achieves the "ready" state, the microcontroller no longer directs cards to that nest. After N nests achieve the ready state (N=number required hands), the device 100 will utilize the touch panel 60 to indicate that the required hands are fully formed within the device and available for delivery upon dealer demand. Alternately, the device 100 may be programmed to automatically deliver the first hand to the delivery tray 72 immediately after any nest achieves the ready state.

Once the newly moved card enters into the forward release rollers (FIG. 16), it will be stopped when its leading edge is detected by optical sensor 143. That card will remain in that state until a randomly selected nest within radial receiver 150 becomes positioned to receive it. After accelerating the forward card from the release rolls into the radial receiver 150, the transport cycle of motors 126 and 127 will be repeated simultaneously with the rotation of the radial receiver 150 to its next insertion position.

Figure 17:
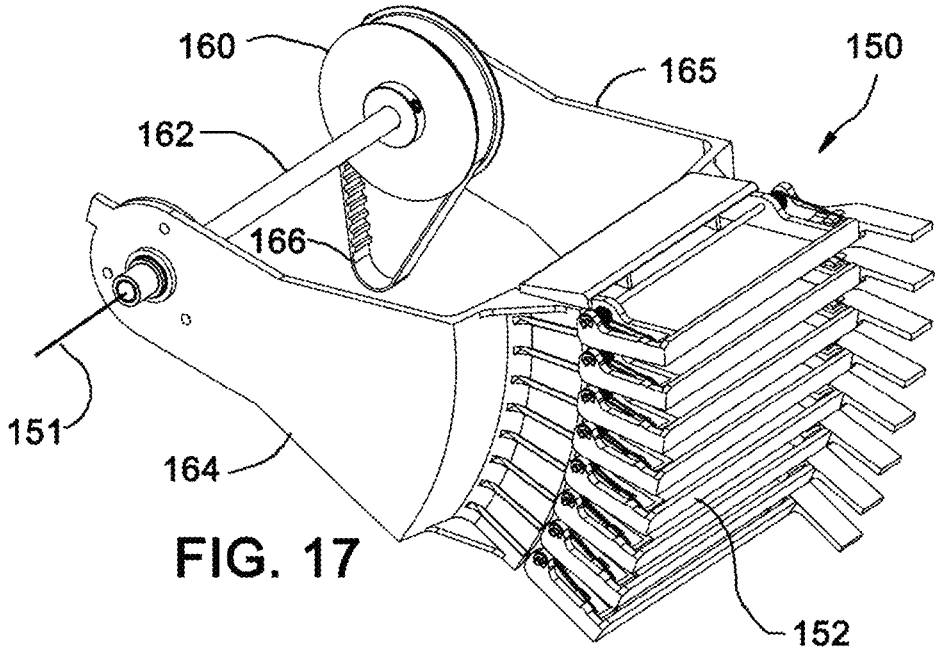
FIG. 17 is a perspective view of the radial receiver of the preferred embodiment.

An isometric view of the rotatable radial receiver 150 is shown in FIG. 17 where this assembly is isolated from the overall mechanism shown in FIG. 13. The radial receiver 150 comprises eight (8) nests 152 which are radially mounted to carrier arms 164 and 165. The entire assembly rotates about axis 151 and is rotationally driven incrementally and bidirectionally amongst the radially-arranged nests by a carrier drive step motor 91 which is shown in FIG. 14. The drive motor is connected to the carrier arm 165 by timing belt 166 and pulley 160 which is rigidly attached to carrier arm 165. Angular motion of the entire assembly 150 is controlled by a microcontroller. The microcontroller and drive motor together are capable of rotating the radial receiver 150 with angular precision and with significant angular acceleration while positioning any one of the eight nests into radial alignment with the card path of the card transport 120.

Figure 18:
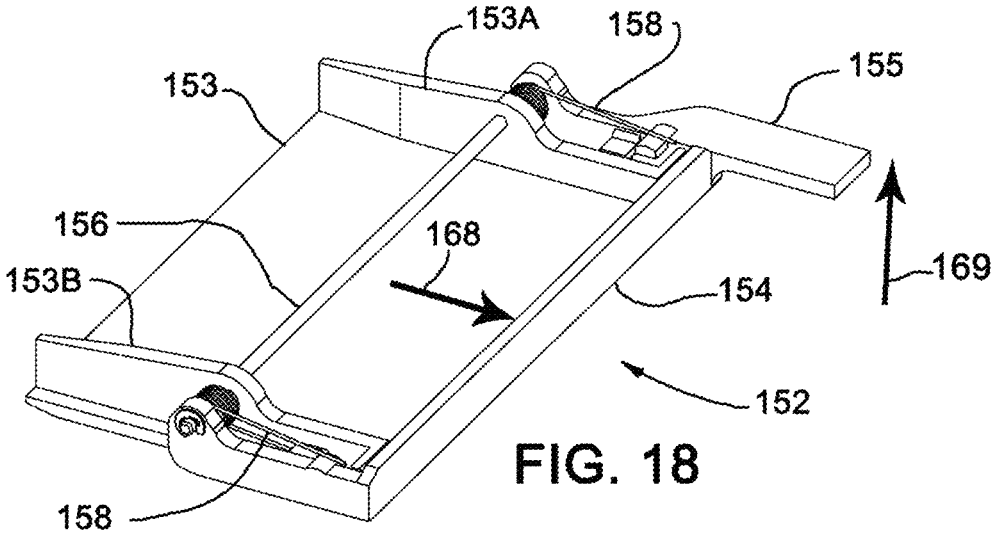
FIG. 18 is a perspective view of the card substack nest of the preferred embodiment.

A single nest 152 is shown isolated in the perspective view of FIG. 18 and comprises a nest base 153 and a movable retainer 154, which are both made of injection molded plastic. Card substacks are retained within the nests laterally by the walls 153A and 153B. The card substacks are retained along the direction of arrow 168 by the retainer 154, where arrow 168 represents the direction of the centrifugal force. Movement against actuation arm 155 in the direction of arrow 169 induces retainer 154 to pivot about a stainless steel pin 156 which functions as the retainer's axle. Two torsion springs 158 hold retainer 154 in the position shown during the operational procedures utilized for distributing random cards to the nests. The edges of the accumulated card substacks are forced against the internal edge of the retainer 154 in the direction of arrow 168 by centrifugal force during rotational motion of the radial receiver 150. The centrifugal force acts in a beneficial manner such that the edges of the substacks are aligned by the retainer during the rotational excursions of radial receiver 150.

Figure 19:
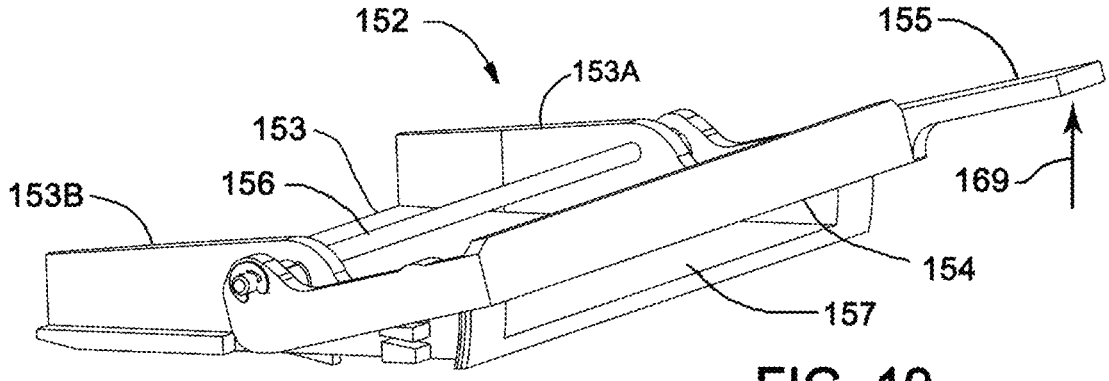
FIG. 19 is another perspective view of the of the card substack nest of the preferred embodiment.

FIG. 19 illustrates the state where the retainer 154 is pivoted to a displaced position, creating an exit orifice 157 which allows the card substacks to escape from the nest 152. The exit orifice is temporarily created by an actuating force that contacts actuation arm 155 in the direction of arrow 169. Movement of arm 155 pivots the retainer 154 about pin 156 against the restoring action of torsion springs 158, thus creating the exit orifice 157.

Figure 20:
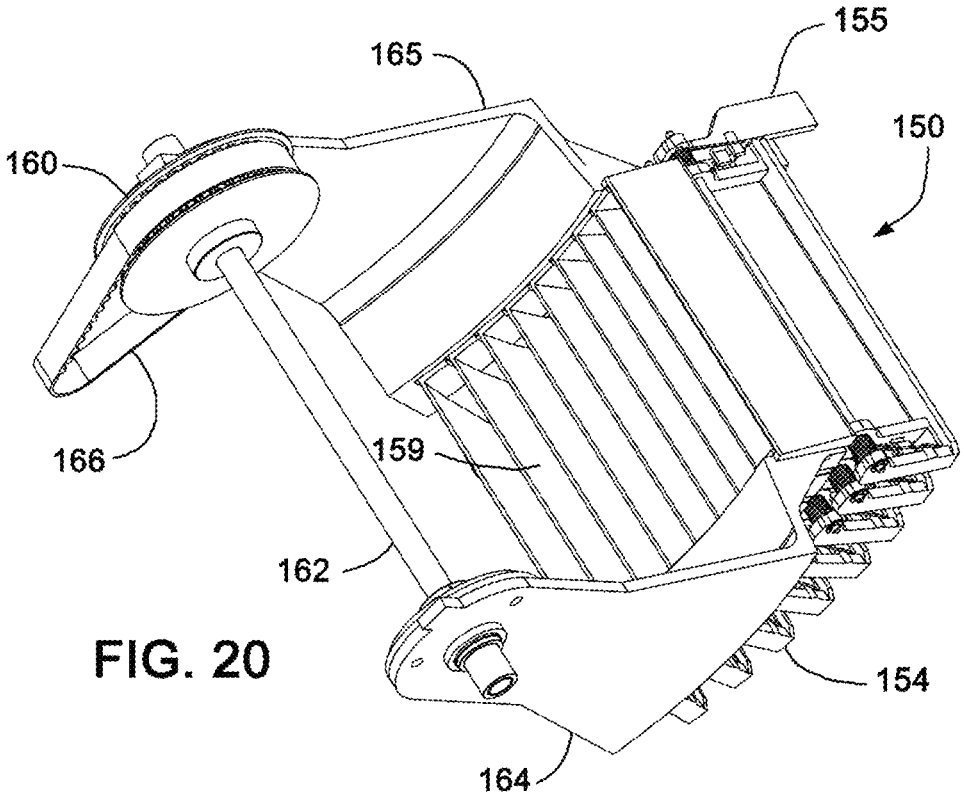
FIG. 20 is a perspective view of the radial receiver assembly of the preferred embodiment.

The entrance orifices 159 to the nests 152 are shown if FIG. 20. This view illustrates the internal nest orifices which are each randomly aligned with the card path of card transport 120 for moving cards individually into the nests 152. Each nest has a capacity of 27 cards which is slightly more than one-half of a card deck. However, the maximum expected hand size is 7 cards in the case of seven card stud poker. The oversize nests guarantee that the card substacks will always be retained loosely within the nests. While the exit orifice 157 (FIG. 19) is sized to allow 27 cards to escape, the entrance orifice of each nest is larger, with an equivalent size of 36 cards. Thus, one characteristic of the preferred embodiment is the distinction that the entrance orifice of each nest is significantly larger than the exit orifice.

Figure 21:
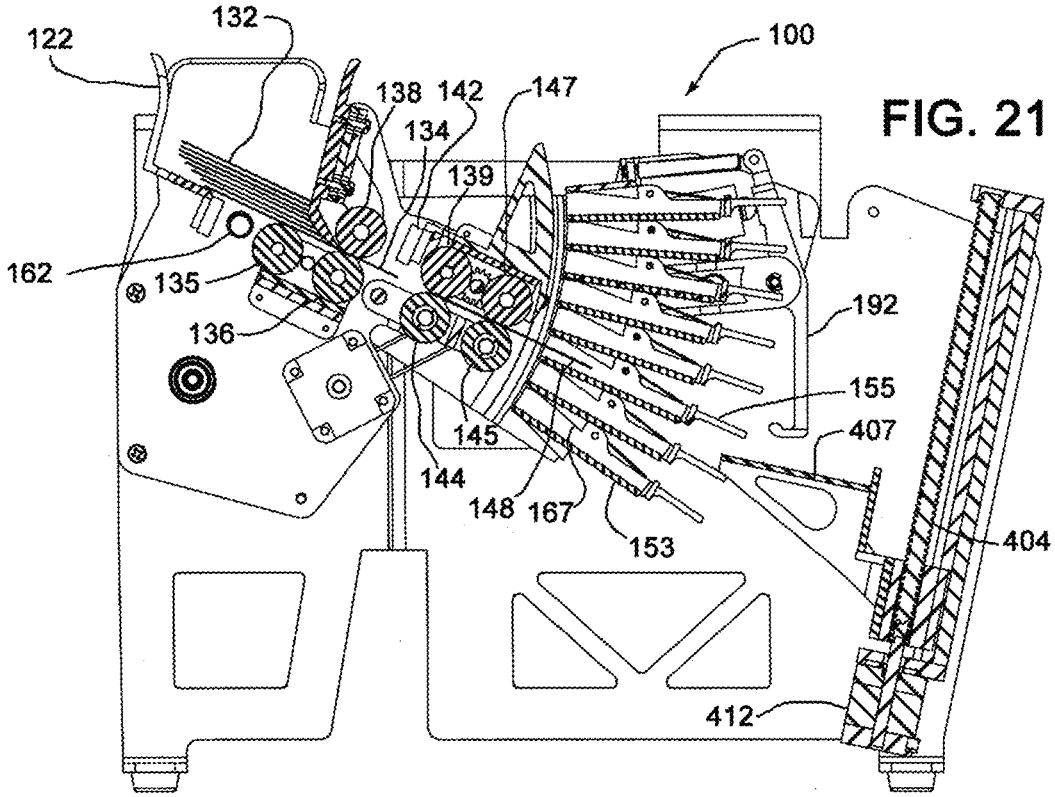
FIG. 21 is a side elevation section view of the preferred embodiment.

A partial side elevational section view of the preferred embodiment is shown in FIG. 21. The bezel 80 and the elevator housing 432 (FIG. 14) have been omitted in this view for explanatory purposes. Only the elevator carriage 407, its driving lead screw 404, and its step motor 412 are shown. Referring to FIG. 21, radial receiver 150 has been rotated about its axle 162 to align a nest (third from bottom) with the card path of the card transport 120. The leading edge of a card 148 is shown entering into the third nest from the bottom of the radial receiver 150. That card is being propelled with acceleration by the release rolls 139, 147, 144 and 145. Each nest base 153 possesses a deflection fin 167 on its lower side, which functions to deflect cards underneath the pivot pin 156. The distance from the floor of nest 153 to the tip of the fin 167 establishes the nest capacity of 27 cards.

Card 134 in FIG. 21 has been advanced until its leading edge is detected by optical sensor 142. It is said to be queued and ready to advance into the release rolls when card 148 enters its target nest. After the trailing edge of card 148 passes the forward sensor 143 (see FIG. 16), the radial receiver 150 will rotate to its next random nest position as directed by the random number generator in the microcontroller. Simultaneously, the card 134 will advance into the release rolls until detected by forward sensor 143 (see FIG. 16).

Figure 22:
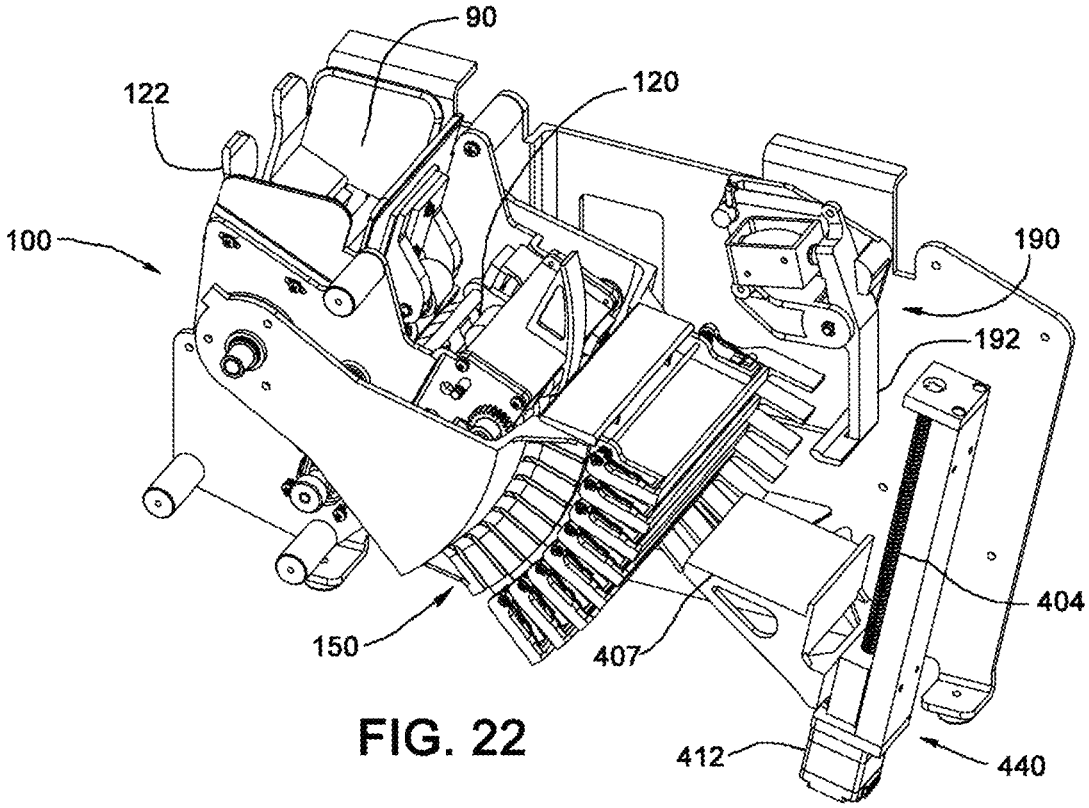
FIG. 22 is a perspective view of the preferred embodiment.
Figure 23A:
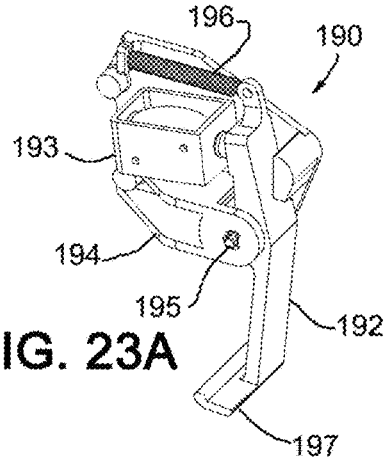
FIG. 23A is a perspective view of the interposer mechanism at rest.
Figure 23B:
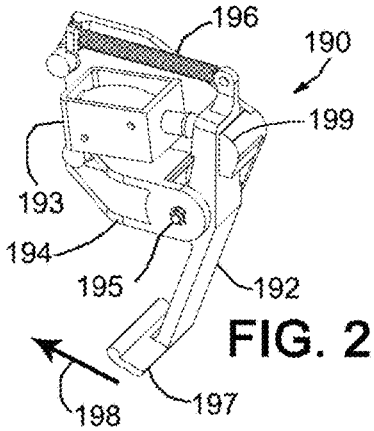
FIG. 23B is a perspective view of the interposer mechanism at actuation.

Centrifugal force moves the substacks from the individual nests of the radial receiver 150 to the elevator carriage 407 after enabling the interposer module 190. Referring to FIG. 22, the interposer module 190 is mounted laterally from the nests and is shown mounted to the rear side frame. FIG. 23A and FIG. 23B explain the operation of the interposer.

Referring to FIG. 23A, the interposer module 190 is shown in isolation. The module consists of an interposer arm 192, a pivot pin 195, an open frame solenoid 193, a return spring 196 and an injection molded mounting plate 194. The interposer 192 is an injection molded component which possesses an actuation finger 197 at its lower extremity. The solenoid is not activated in FIG. 23A and the return spring 196 is holding the interposer arm 192 in the position shown, which is called the interposer rest position. In FIG. 23B, the solenoid 193 has been actuated by a voltage pulse which causes the interposer arm 192 to rotate clockwise about pin 195, moving the interposer finger 197 in the direction of arrow 198. Rotation of the interposer is stopped by projection 199 which is an integral part of the mounting plate 194. This state is called the interposer actuated position.

The interposer arm 192 is used to enable the movement of any of the movable retainers 154 by intercepting the path of any of the eight actuation arms 155. Referring to FIG. 21, the interposer 192 is shown in its rest position where it is unable engage the path of the arms 155.

Figure 24:
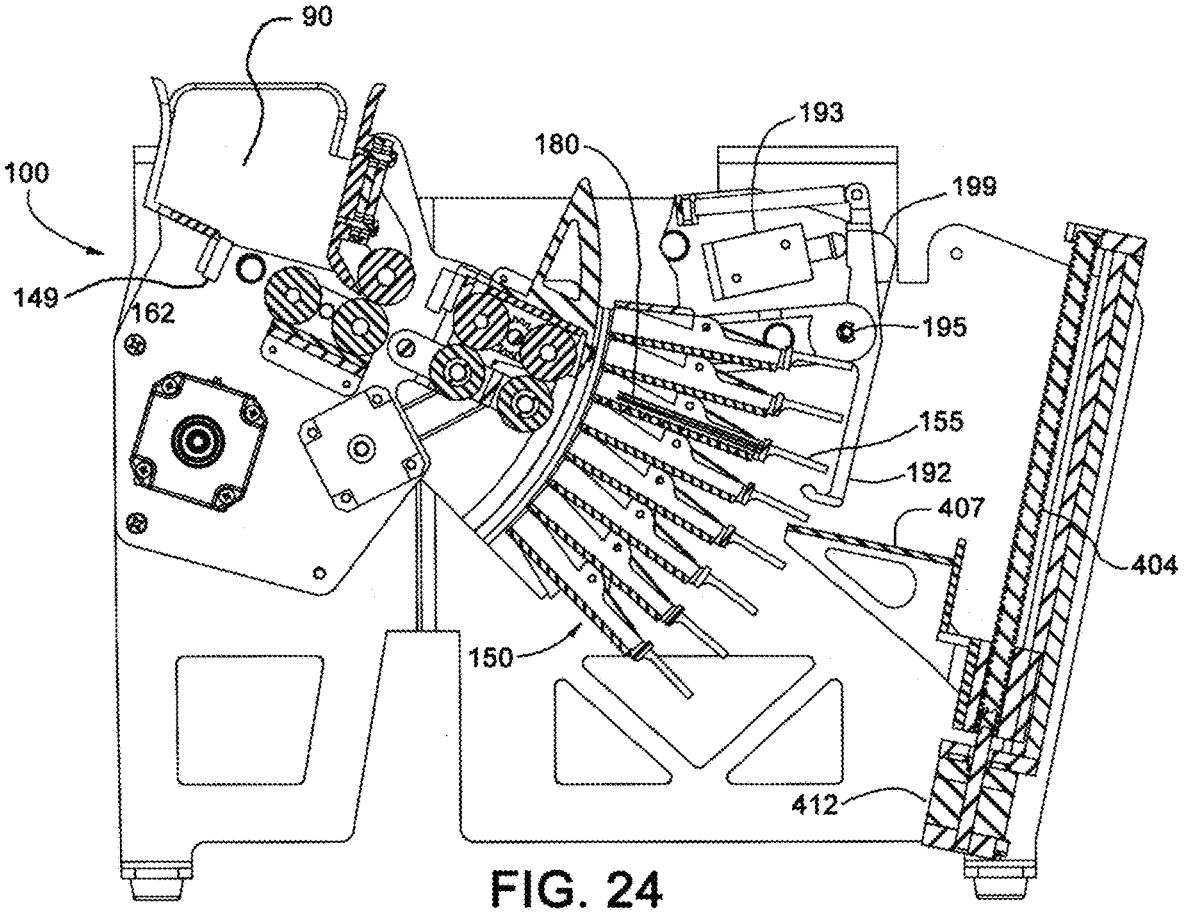
FIG. 24 is a side elevation view showing the preferred embodiment in its "pre-launch" state.

Referring to FIG. 24, the interposer is shown in the actuated position and the radial receiver 150 has been rotated about axle 162 to a "pre-launch" position prior to launching substack 180 onto elevator carriage 407. The elevator carriage 407 is shown in its loading position where it resides when moving substacks from all compartments 152. The radial receiver 150 has been momentarily stopped while the interposer finger 197 is injected into the path of the 3rd nest from the top and is in a position to intercept arm 155 of that nest when the radial receiver 150 next rotates clockwise. FIG. 24 thus illustrates the "pre-launch" state of the device 100 when it is about to move card substack 180 onto elevator carriage 407.

Figure 25:
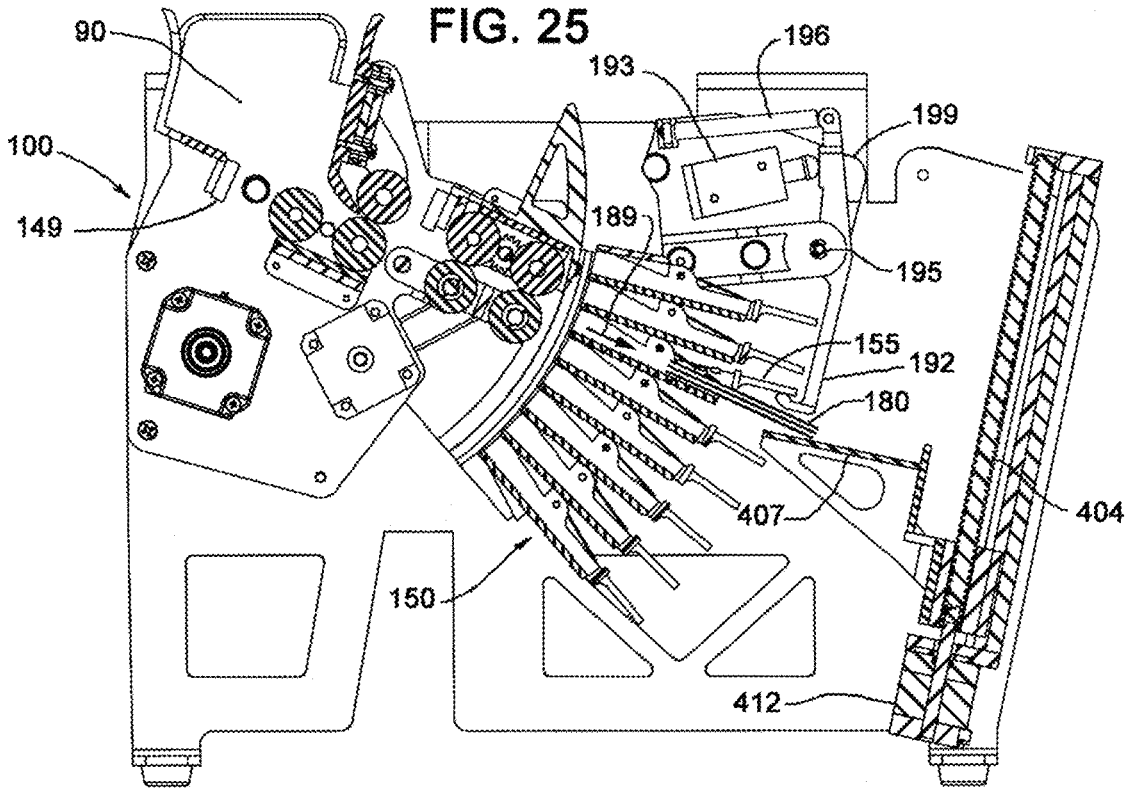
FIG. 25 is a side elevation section view showing a card substack being launched onto the elevator carriage.

While interposer arm 192 is held in this actuated position (FIG. 24), the radial receiver 150 is thereafter rapidly rotated clockwise and rapidly stopped at the card delivery position as shown in FIG. 25. The deceleration causes centrifugal force to rapidly discharge the substack 180 into the elevator carriage 407 while the moveable retainer 154 is restrained. Arrow 189 in FIG. 25 indicates the direction of the centrifugal force upon the card stack 180 as the radial receiver 150 reaches its terminal clockwise destination. After a momentary pause, the radial receiver 150 is returned counterclockwise to the "pre-launch" position and the solenoid 193 is deenergized, allowing the interposer spring 196 to extract the interposer finger 197 (FIG. 23B) from the path of actuator arms 155. The device 100 is then ready to move a shuffled (randomized) substack from another nest 152 to the elevator carriage 407.

Once delivered to the elevator carriage 407, the device randomly positions another nest of the radial receiver 150 to the "pre-launch" position and actuates the interposer 192. Simultaneously, the elevator carriage 407 is elevated to deliver the substack 187 to the delivery tray 72. Upon return of the elevator carriage to its loading position, the centrifugal discharge cycle of the radial receiver 150 is repeated to move another substack to the elevator carriage 407.

In an alternate, but less advantageous embodiment, the radial receiver 150 may be rotated slowly to a state wherein the card substacks are moved to the elevator carriage 407 by gravity, rather than by centrifugal force. In this alternate embodiment, the card receiver rotates slowly to disgorge each nest substack after the interposer 192 has intercepted the moveable retainer 154.

As the radial receiver 150 approaches the aligned position, the card substack thereafter slides onto the elevator carriage 407 solely by gravity.

After the hands have been distributed to all players, there are various amounts of cards left in the nests and in the unshuffled card portal. For example, for certain 7-card stud games such as "Rollover" or "Baseball", each hand consists of seven cards which are delivered to each player, and no additional cards are needed for that game. If there are five players, then thirty-five (35) cards will have been dealt, leaving seventeen (17) cards within the shuffler. Some of these residual cards will have been delivered to unfilled nests and some will remain within the unshuffled card tray 122. Comparatively, a game of Three-Card Poker® with five players will only utilize eighteen (18) cards (five player hands and one dealer hand). In this latter case, the majority of cards will remain unplayed and the dealer will purge the device of these residual cards before starting a new game. This process is called the purging cycle.

While forming hands, the microcontroller tracks the number of cards moving into and out of each nest, and "knows" how many residual cards remain in each nest, if any, at the end of each poker game. Within the purging cycle, the microcontroller rotates each non-empty nest appropriately to unload the residual substacks onto the elevator carriage 407 where they are thereafter delivered to the delivery tray 72. However, the microcontroller does not "know" the number of cards remaining in the unshuffled card portal.

The dealer has options in regard to purging those cards remaining in the unshuffled card portal. In one embodiment, the dealer may program the device 100 to sort the cards remaining in the unshuffled card portal into the nests, and thereafter deliver them to the delivery tray 72. In another embodiment, the dealer may program the device to rapidly deliver the unshuffled cards directly from the unshuffled card portal to the elevator carriage 407. This latter option is accomplished by aligning any nest within the radial receiver 150 with the path of the card transport as shown in FIG. 26, such that individual cards may be rapidly moved to the elevator carriage 407 without requiring temporary storage within the radial receiver 150.

Figure 26:
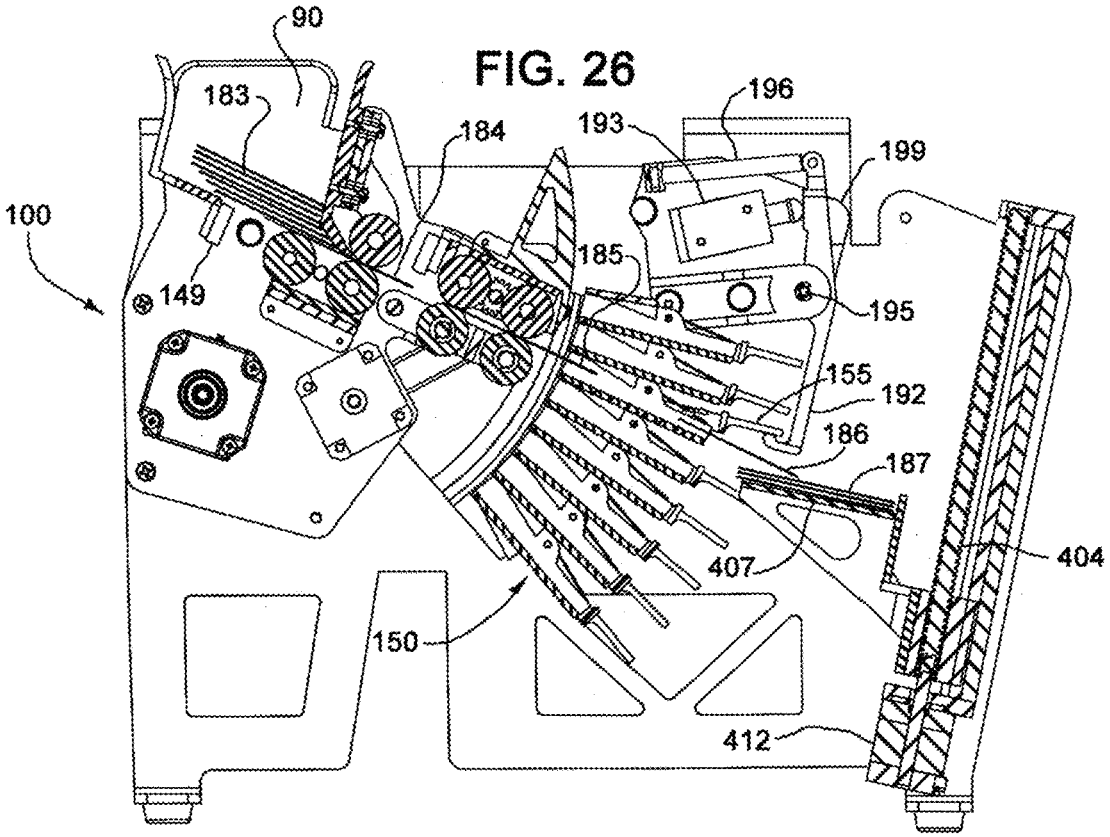
FIG. 26 is a side elevation section view showing individual cards being purged from the input portal.

Referring to FIG. 26, an optical sensor 149 is located in the floor of the unshuffled card portal 90 which alerts the microcontroller that cards remain which must be purged. The radial receiver 150 may be positioned to provide a direct path for rapidly moving cards from the unshuffled card portal to the elevator carriage 407. During this portion of the purging cycle, any nest 153 can be aligned with both the card path and the elevator carriage. Referring to FIG. 26, individual cards 184, 185, and 186 are being rapidly moved directly from the residual card stack 183 to the card stack shown as 187 on the elevator carriage 407, without requiring any movement of the radial receiver 150 and the optical sensor 143 will have finished its card count when the sensor 149 indicates that the unshuffled card portal is empty.

At the termination of the purging cycle, the microcontroller will display the card count on the touch panel 60. If the count is unexpected, as for example from cheating by a player or dealer, then an error message and warning will be signaled to the dealer such as by a flashing visual indicator or audible warning. In this way, the deck size may be properly validated before commencing the next game.

Figure 1:
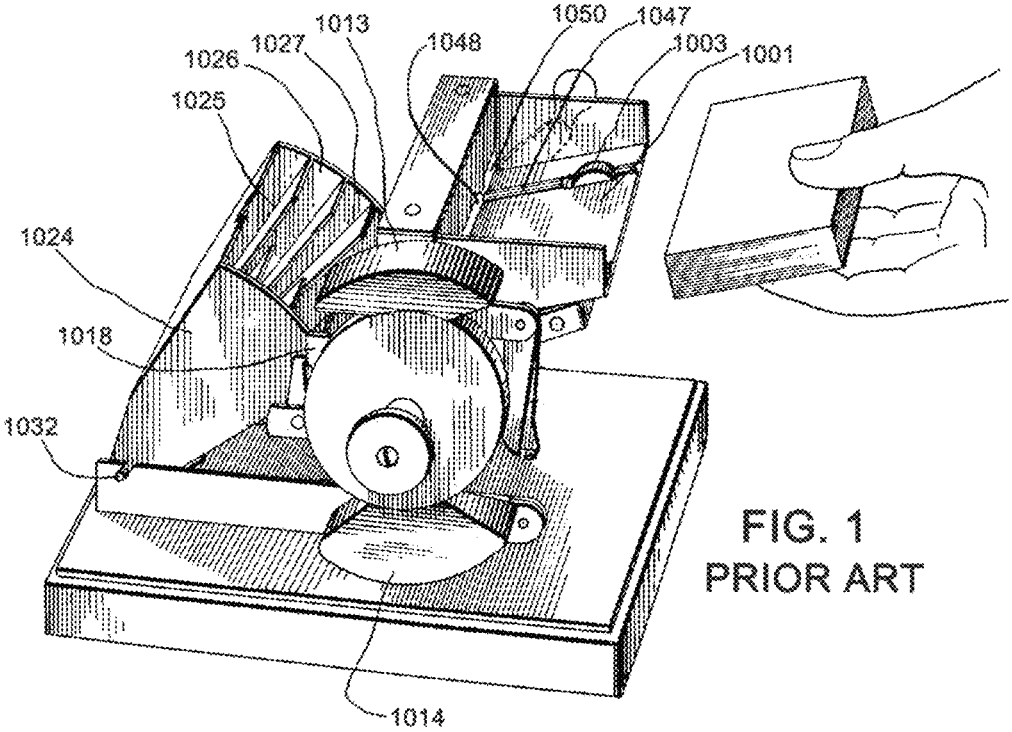
FIG. 1 PRIOR ART
FIG. 1 is a perspective view from an early (1932) hand-forming shuffler patent.
Figure 2:
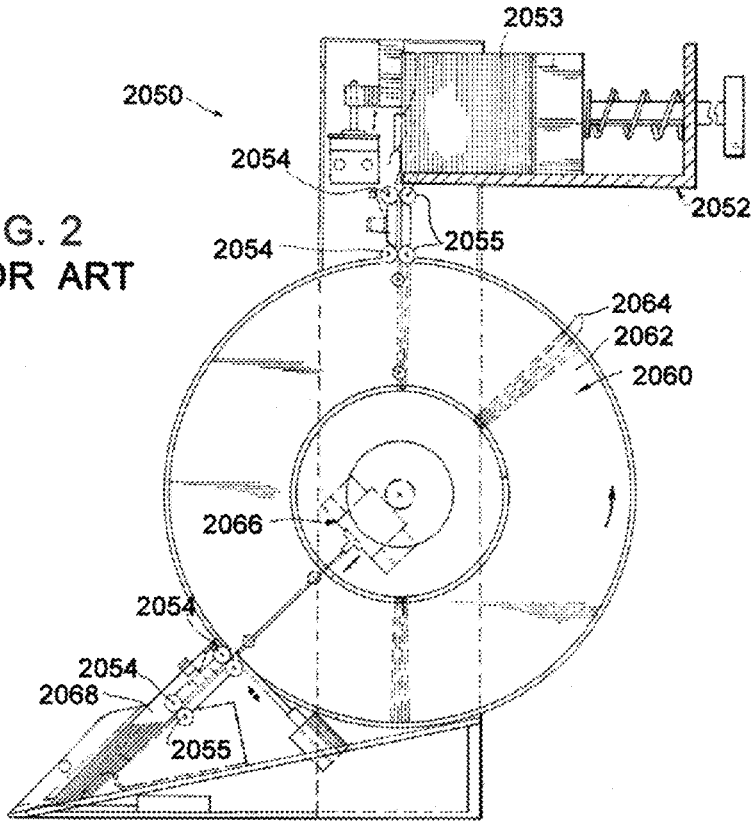
FIG. 2 PRIOR ART
FIG. 2 is a perspective view from a prior art (1986) carousel shuffler patent disclosure.
Figure 3A:
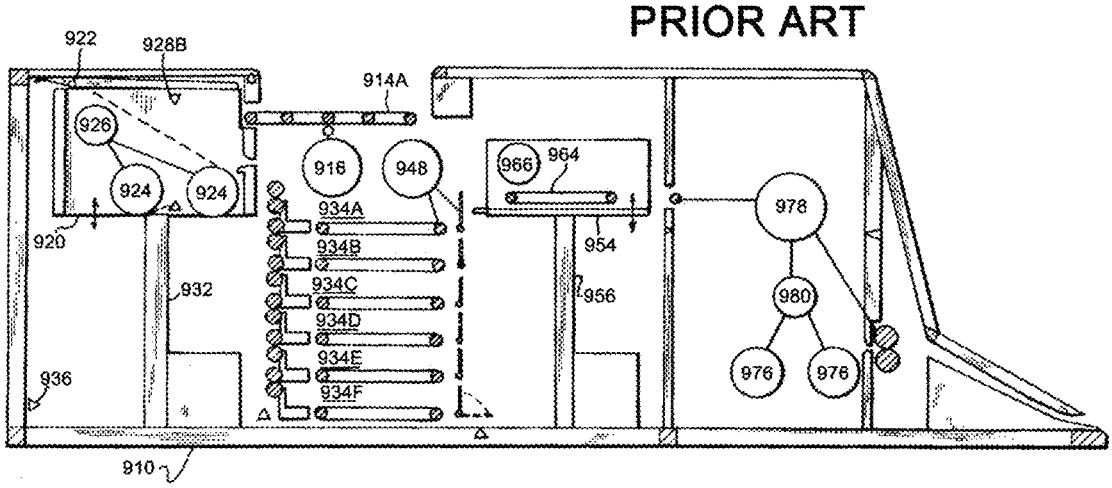
FIG. 3A PRIOR ART
FIG. 3A is a side elevation view from a prior art (1988) elevator shuffler patent disclosure.
Figure 3B:
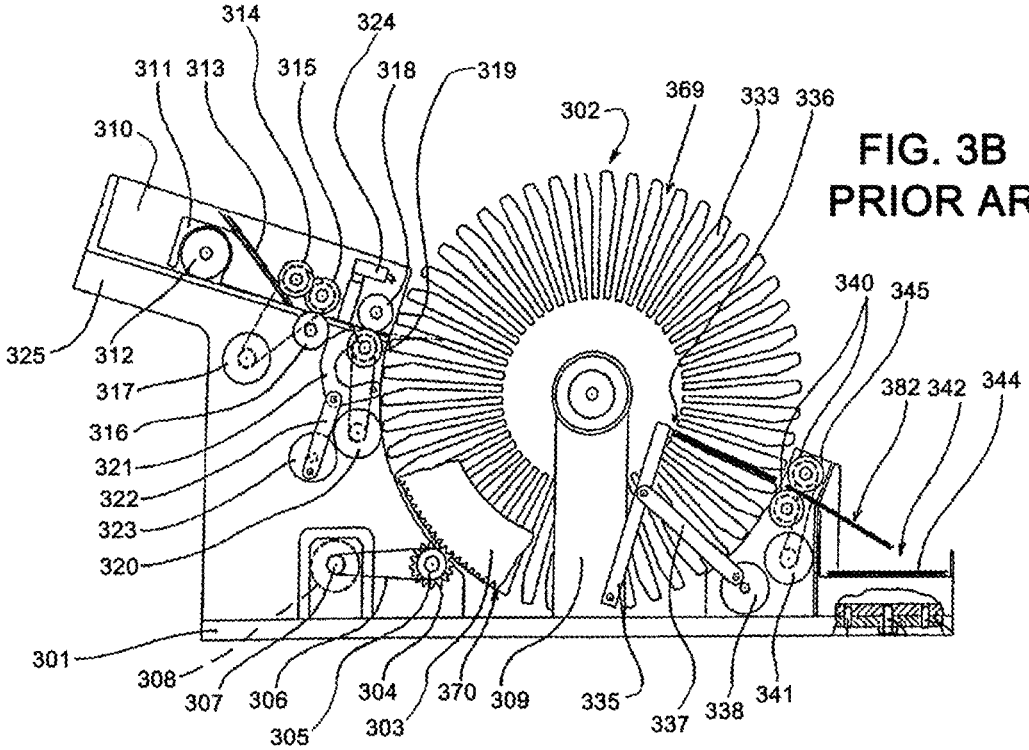
FIG. 3B PRIOR ART
FIG. 3B is a side elevation view from a prior art (2003) carousel shuffler patent disclosure.
Figure 4:
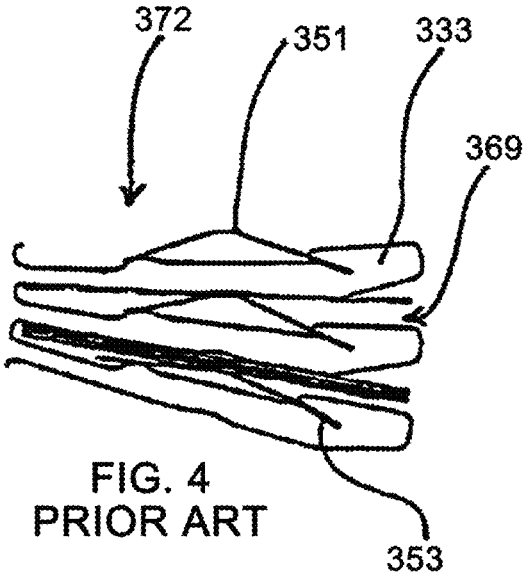
FIG. 4 PRIOR ART
FIG. 4 is a view of a clamping means from the prior art carousel shuffler patent disclosure in FIG. 3.
Figure 5:
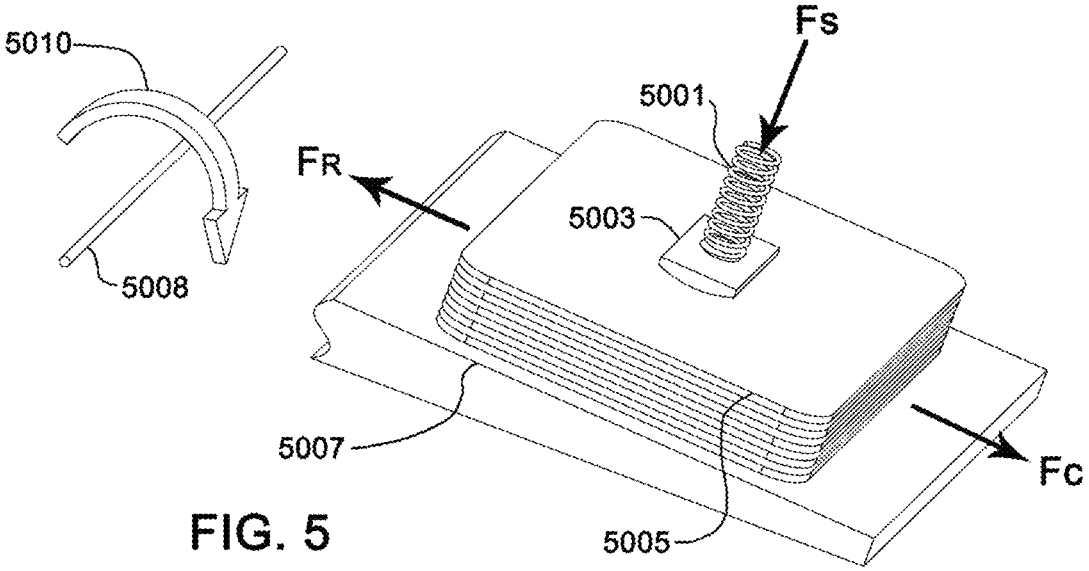
FIG. 5 is a diagram explaining the physics of the carousel clamping forces.
Figure 6:
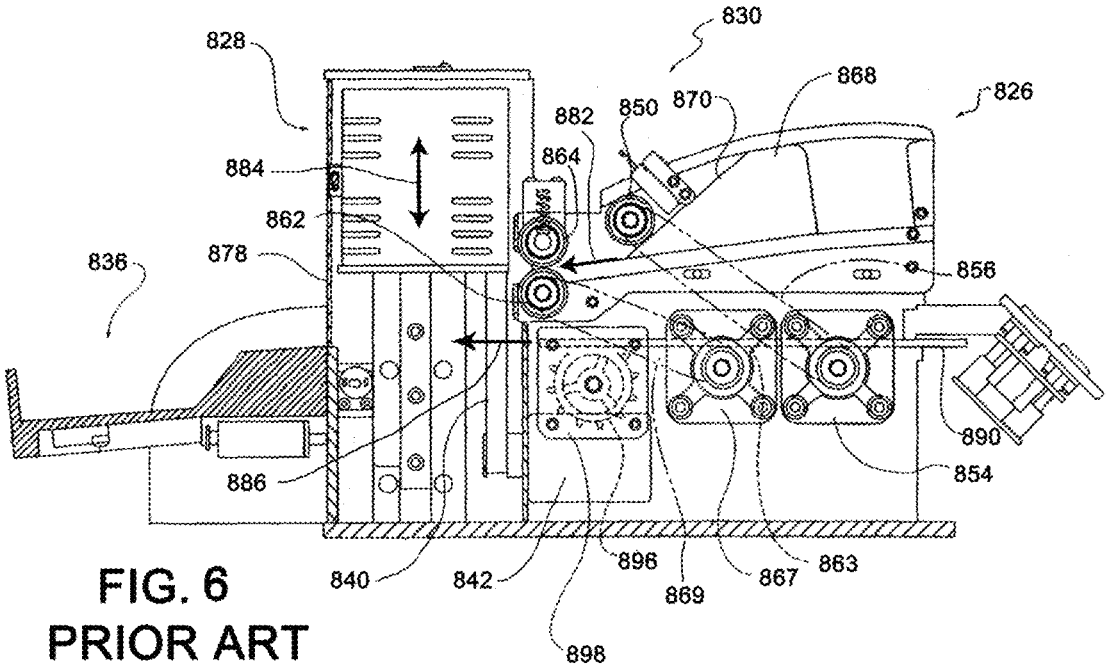
FIG. 6 PRIOR ART
FIG. 6 is a side elevation view from a prior art (2000) elevator shuffler patent disclosure.
Figure 7:
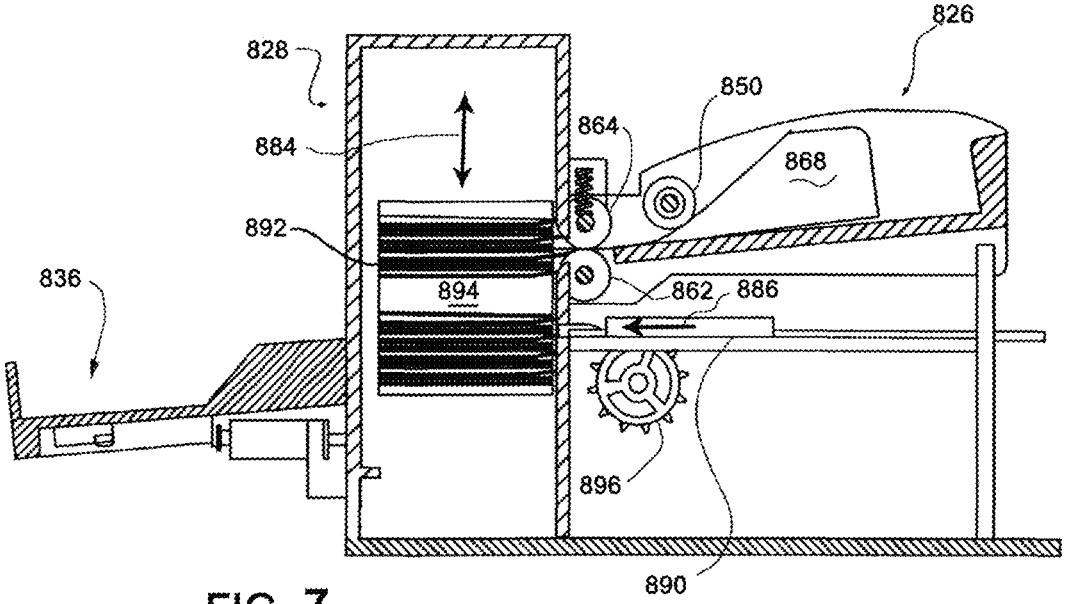
FIG. 7 PRIOR ART
FIG. 7 is another view from the prior art carousel shuffler patent disclosure in FIG. 6.
Figure 8:
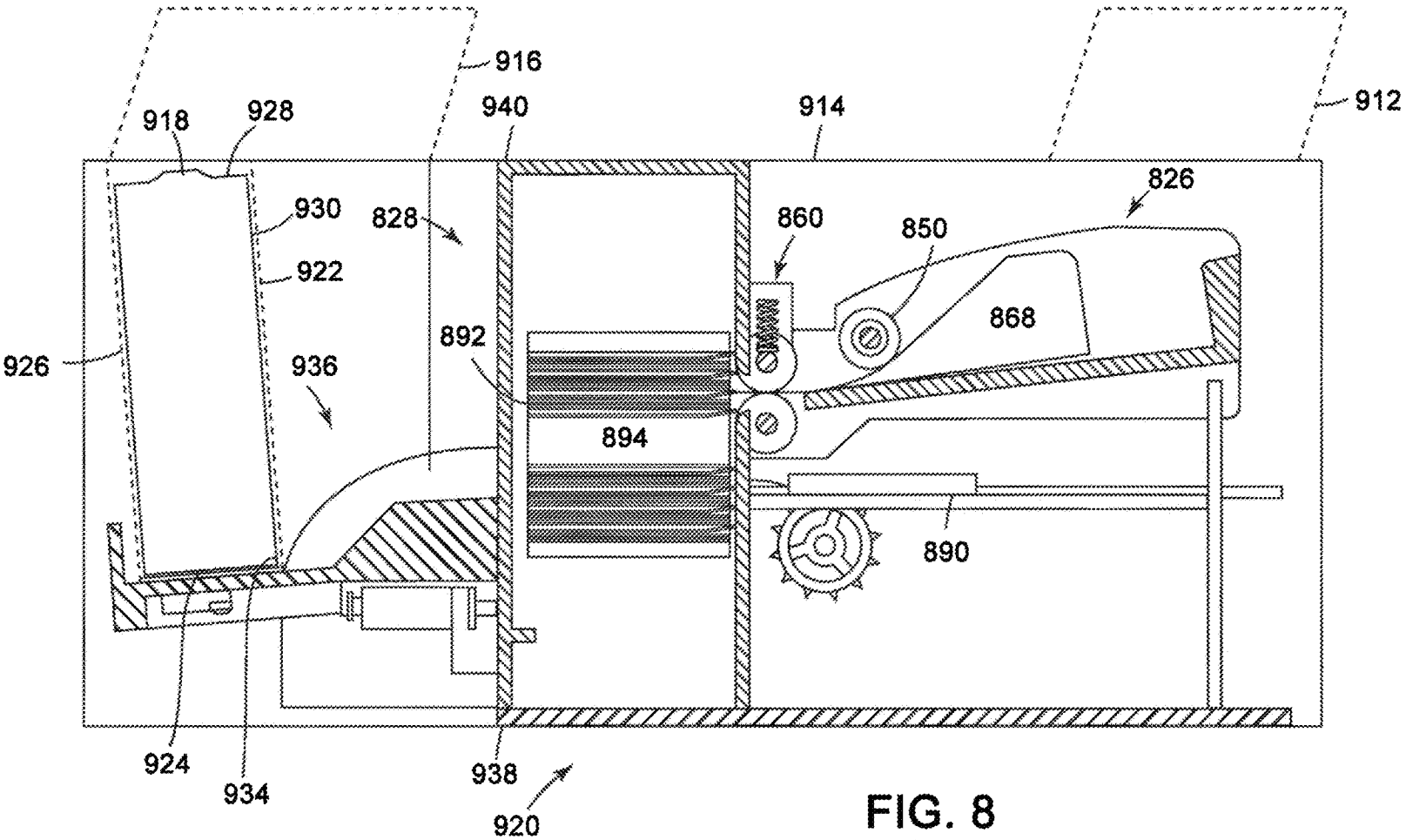
FIG. 8 PRIOR ART
FIG. 8 is a side elevation view from a prior art (2018) shuffler patent application which discloses embedding the shuffler of FIG. 6 into a flush-mounted table.
Figure 27:
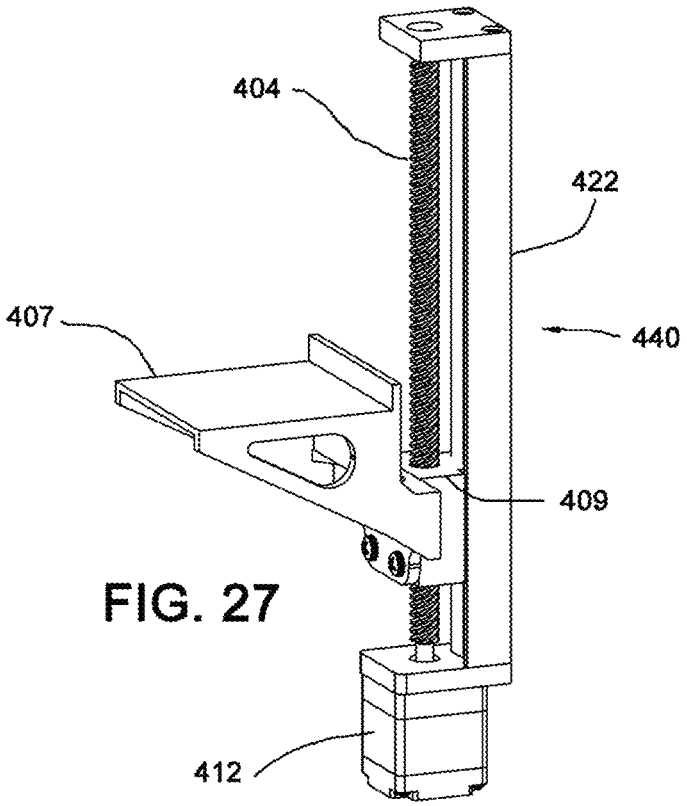
FIG. 27 is a perspective view of the elevator assembly.
Figure 28:
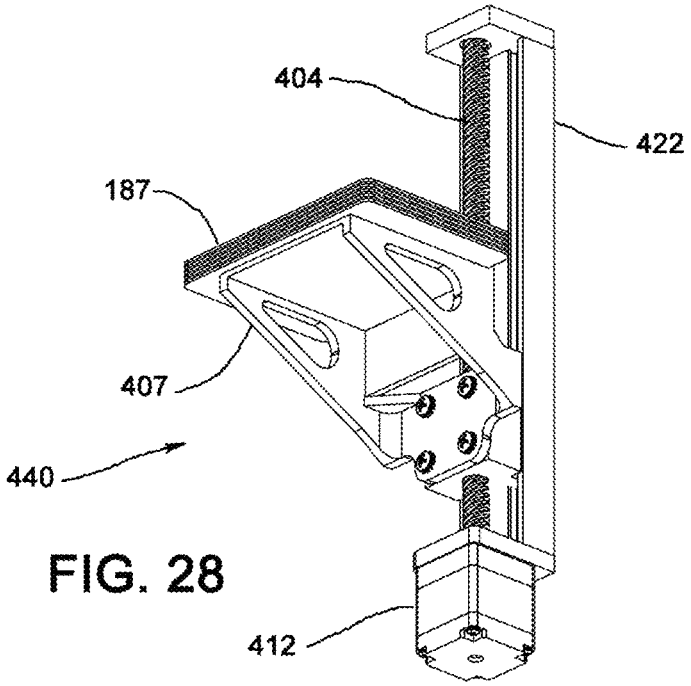
FIG. 28 is a perspective view of the elevator assembly while supporting a card stack.

FIG. 27 shows the construction of the elevator assembly 440 in more detail. Elevator carriage 407 is an injection molded component that is suspended upon lead screw follower 409 which is moved along the axis of elevator frame 422 by lead screw 404. The carriage 407 consists of a simple platform and is referred to as a slot-less elevator. This term comes from the art wherein multi-slotted elevators are common, such as those shown in FIG. 6, FIG. 7 and FIG. 8. Step motor 412 is attached directly to the lead screw 404 and provides rotation to the lead screw. FIG. 28 illustrates a view of the lead screw assembly when supporting a stack of cards 187. This view illustrates that the elevator carriage 407 supports the card stack in a central location, leaving lateral margins for the passage of a stripper mechanism which is explained below.

Figure 29:
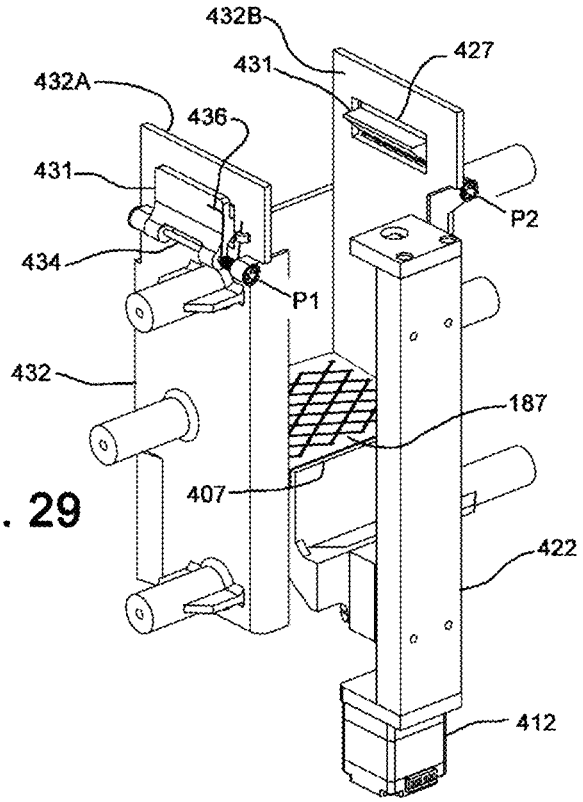
FIG. 29 is a perspective view of the elevator housing.

The elevator operates within an elevator housing 432 as shown in FIG. 29 where a substack 187 is positioned upon the elevator carriage 407. Card substacks are laterally contained within the housing by walls 432A and 432B such that the substacks are loosely guided along their edges while keeping the substack laterally centralized upon the elevator carriage 407. After receiving a card substack 187, the elevator carriage 407 raises the substack to the upper region of the housing 432, where the substack 187 is transferred by a stripper mechanism to the delivery tray 72. The stripper mechanism comprises a pair of support pawls which are labeled as 431 in FIG. 29 and whose function is to strip the substacks 187 from the elevator carriage 407. Referring to FIG. 29, the support pawls 431 are rotatably mounted to the walls of the housing 432 and rotate upon pivot pins 434, which are held in a supporting position by torsion springs 436. A portion of each support pawl penetrates the elevator housing through windows 427 which are located within walls 432A and 432B.

Figure 30:
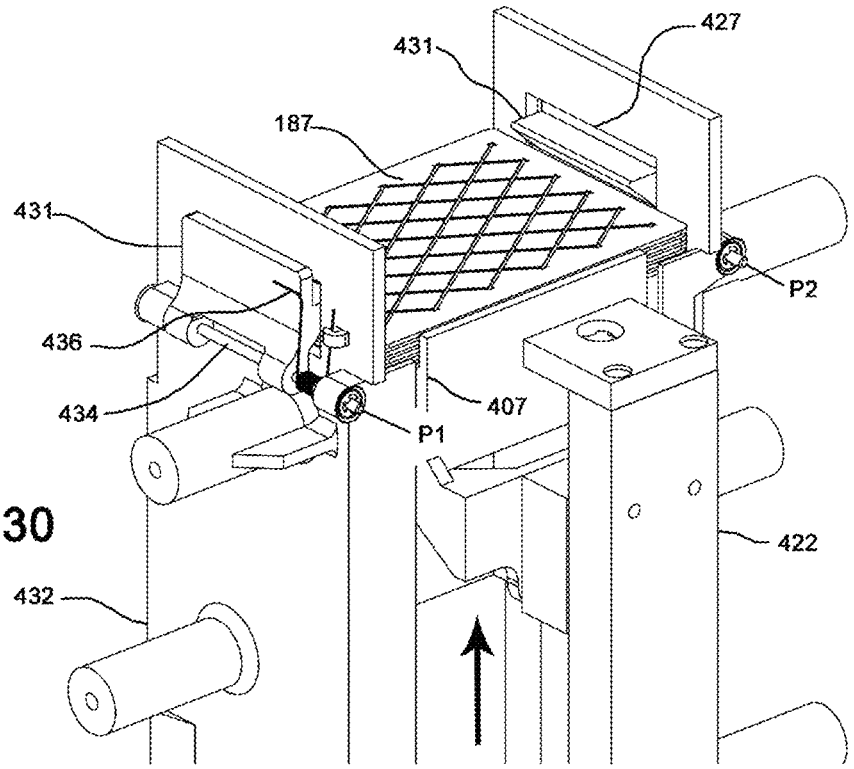
FIG. 30 is another view of the elevator housing as a card stack is about to make initial contact with the support pawls.

Referring to FIG. 30, the two pivot pins 134 form axes P2 and P3, about which the support pawls 431 rotate. As the elevator carriage 407 raises the substack towards the upper opening of the housing 432, the substack 187 pushes against angular surfaces 431A on the underside of the support pawls 431, forcing them outward. The substack 187 is just about to collapse the support pawls 431 in the position shown in FIG. 30 where the elevator carriage 407 is moving in the direction of the arrow.

Figure 31A:
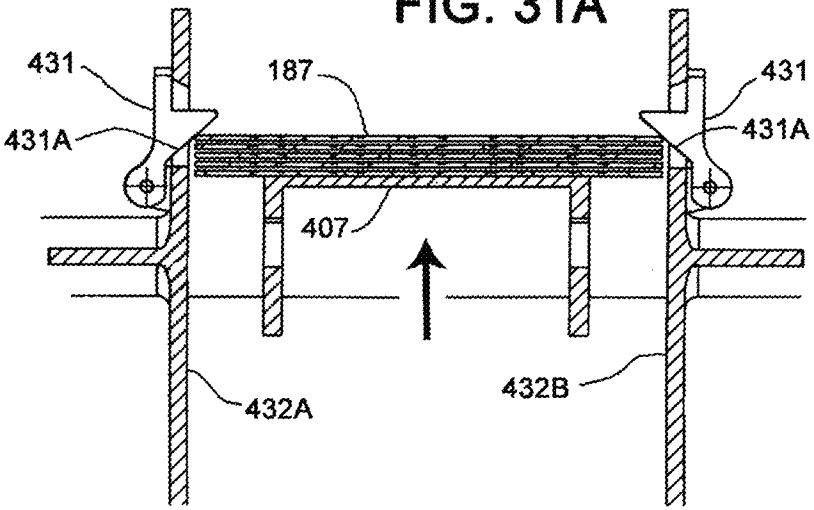
FIG. 31A through FIG. 31D illustrate the stripping mechanism motion sequence.
Figure 31B:
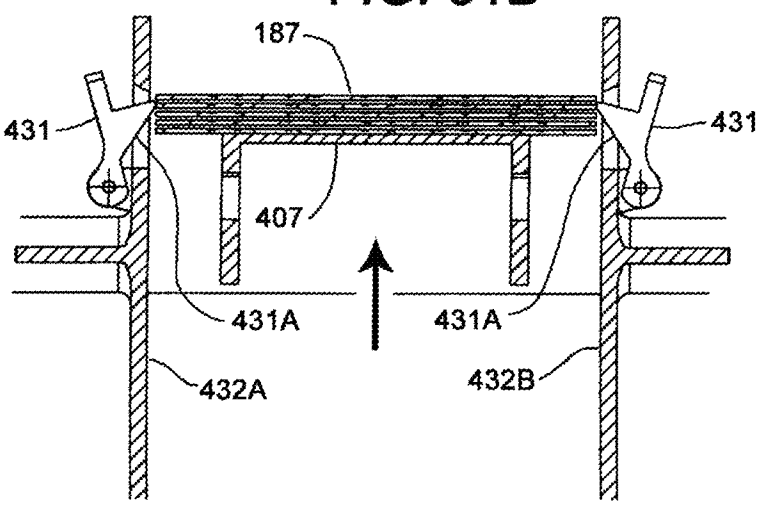
Figure 31C:
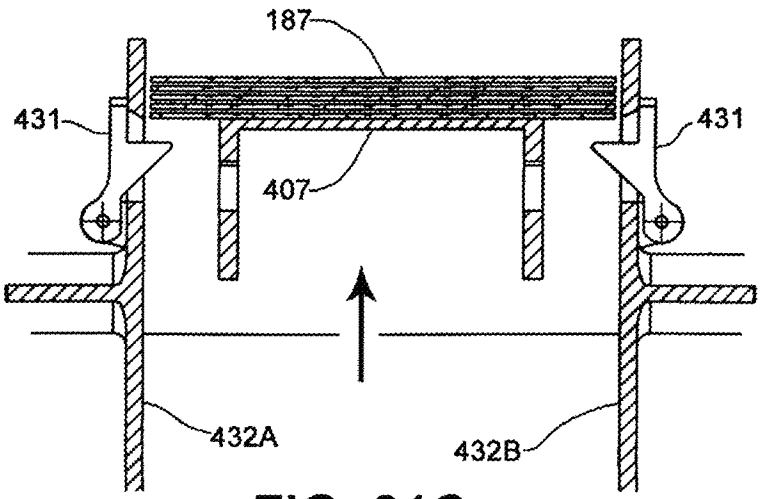
Figure 31D:
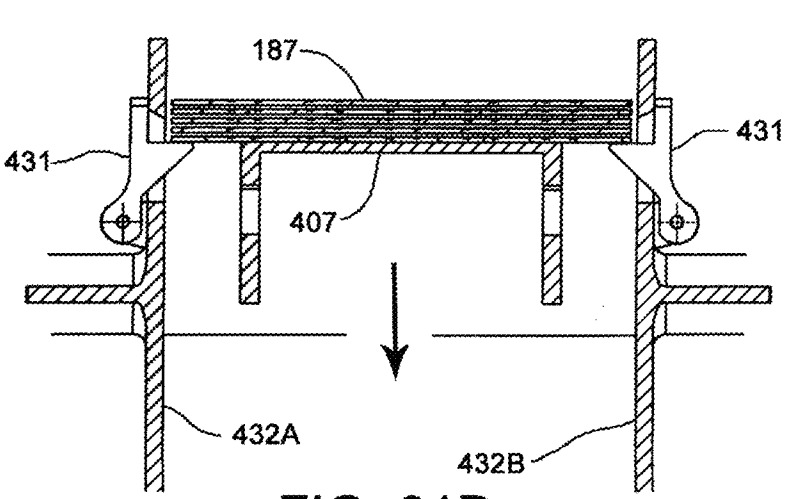

FIGS. 31A, 31B, 31C, and 31D illustrate side elevational section views which explain the sequence of collapsing the support pawls 431. This sequence is called the "stripper cycle" which consists of the steps utilized by the elevator mechanism 440 to temporarily transfer a substack to the support pawls 431. In FIG. 31A, a substack 187 is shown approaching the support pawls from below where the substack edges are making initial contact with the angular surfaces of the support pawls 431. Referring to FIG. 31B, as the elevator carriage 407 raises the substack, the support pawls 431 are pivoted outwardly away by contact between the angular surfaces 431A and the lateral surfaces of the substack 187. FIG. 31C shows that the substack is raised slightly above the support pawls 431, allowing them to snap back into position as urged by torsion springs 436 (see FIG. 30). In FIG. 31D, the elevator carriage 407 has transferred the substack to the support pawls 431, and the elevator carriage 407 continues moving downward. The elevator carriage 407 thus transfers the substack 187 to the support pawls 431 by a downward motion of the elevator.

Figure 32:
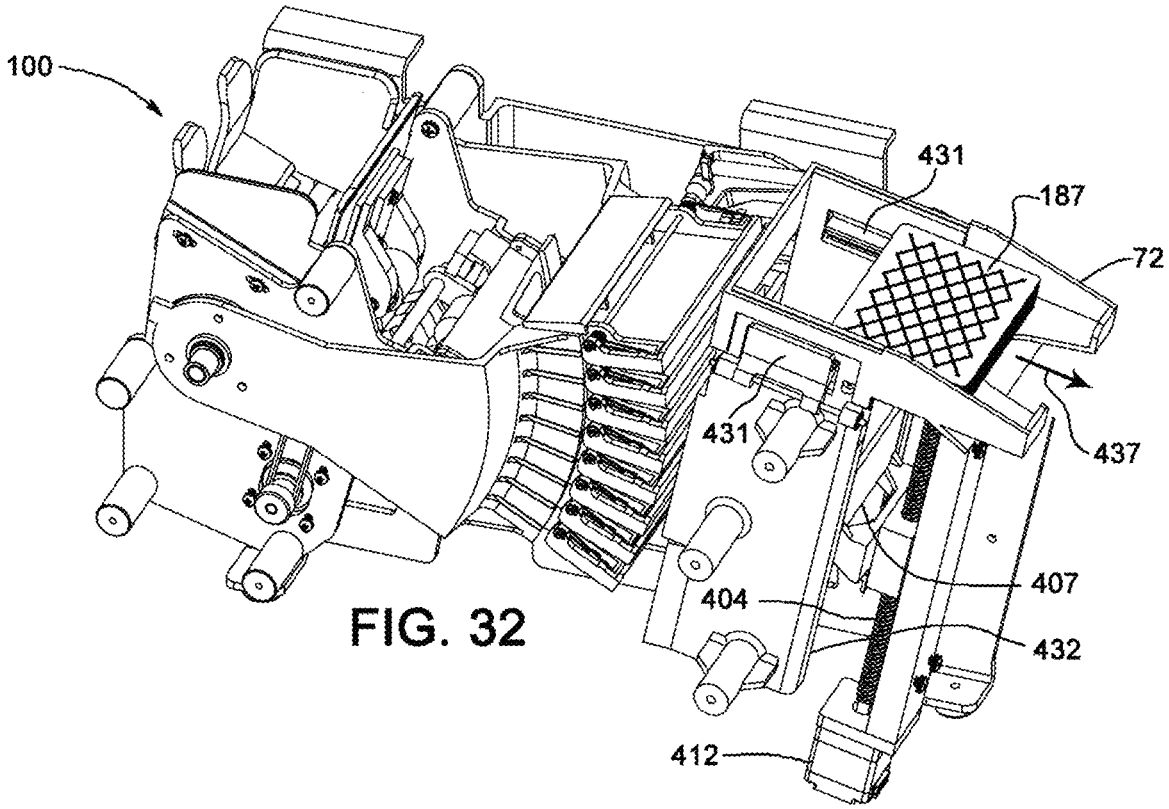
FIG. 32 illustrates a card stack moving into the delivery tray.

The substack 187 resides upon the support pawls 431 only momentarily as the elevator carriage 407 is retracted. The delivery tray 72 is shown attached to the elevator housing 432 in FIG. 32. The support pawls are angularly mounted so as to allow the substack 187 to slide into the delivery tray 72 by gravity, as illustrates by the arrow 437 in FIG. 32. After transferring the substack 187 to the support pawls, the elevator carriage 407 is thereafter withdrawn to the loading position for reloading another substack. A first substack may reside within the delivery tray 72 while a second substack is being moved onto the elevator carriage from the radial receiver 150, or while a second substack is being elevated to the support pawls 431.

Figure 33:
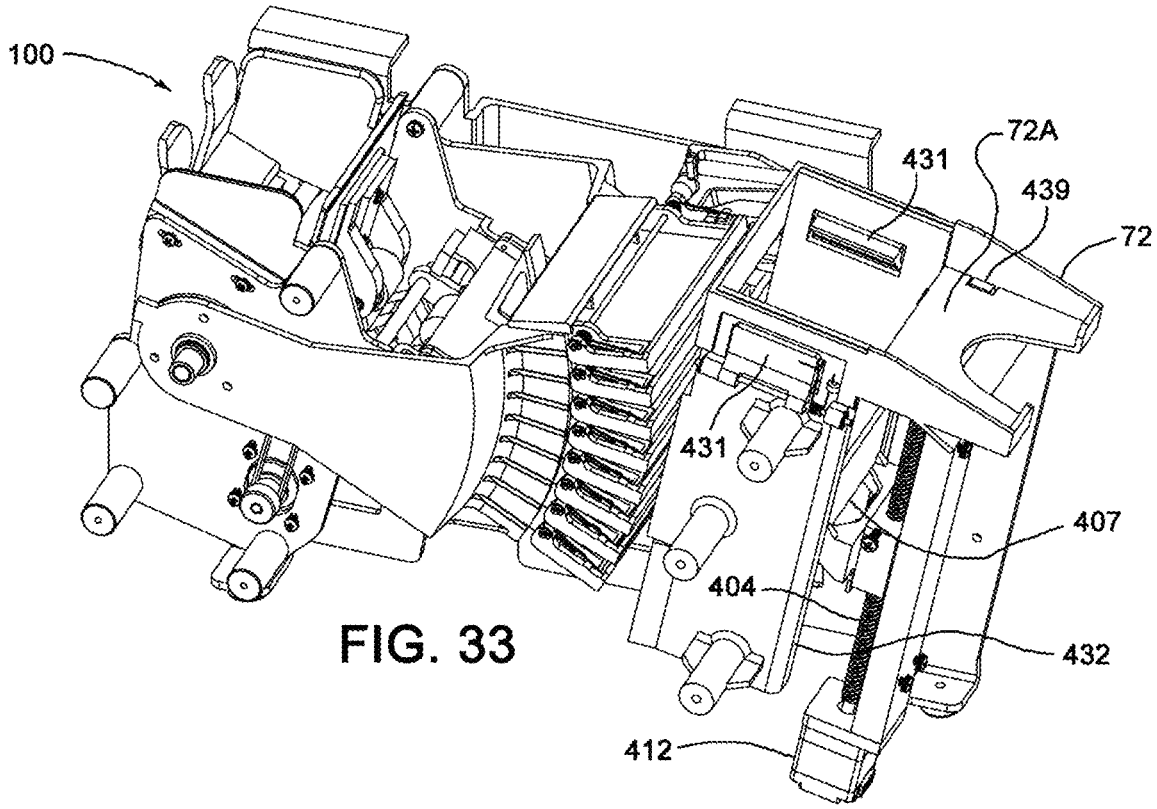
FIG. 33 is an isometric view of the preferred embodiment which shows the stripper mechanism and the delivery tray when the device bezel is removed.

Referring to FIG. 33, the delivery tray 72 possesses a support surface 72A for receiving the play-ready substacks. Residing slightly below surface 72A is a sensor 439 for sensing the presence of a substack. If the sensor 439 indicates that the delivery tray 72 is empty, then a pending stripper cycle can be initiated. If a first substack resides within the delivery tray 72, the microcontroller may direct a second substack to be loaded onto the elevator and place the elevator carriage 407 just below the support pawls while awaiting removal of the first substack. In one programmable operating mode, the next delivery cycle is initiated by the dealer via a command on the touch screen 61. In an alternate programmable operating mode, the device automatically disgorges the next substack when the sensor 439 indicates that the dealer has removed a substack. The disgorgement cycle repeats sequentially until all of the required substacks are moved from the radial receiver to the delivery tray 72.

Figure 34:
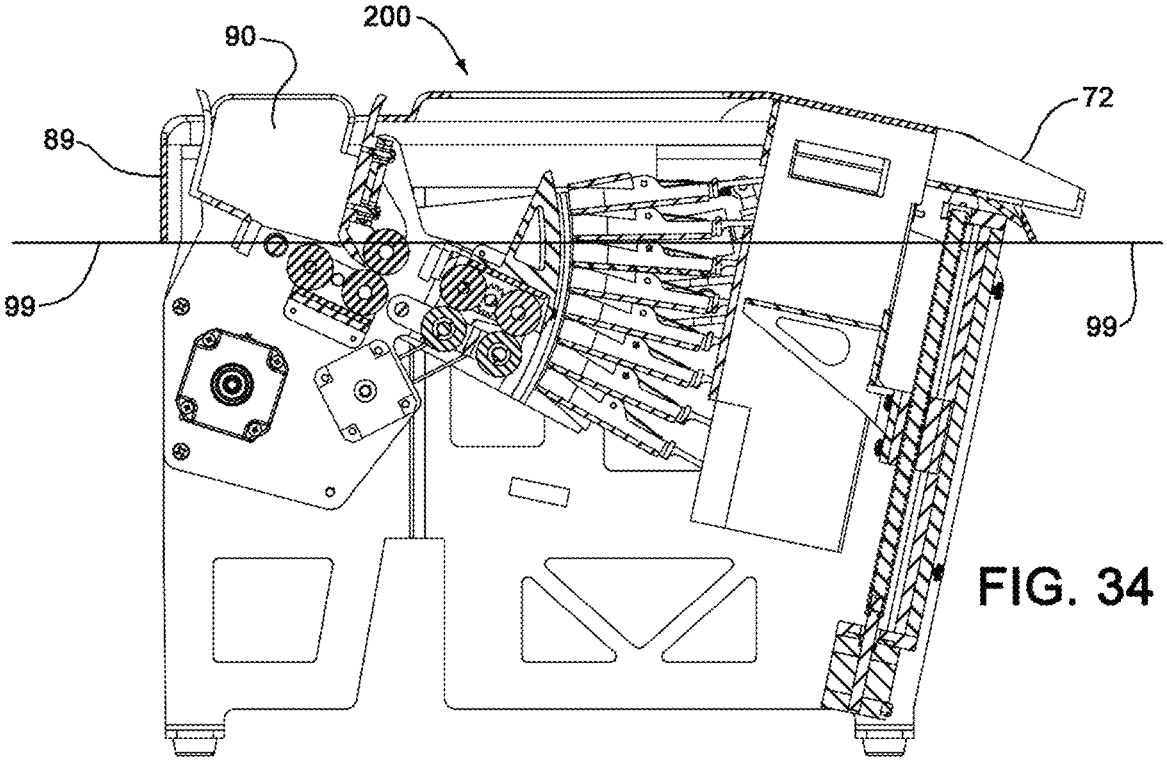
FIG. 34 is a section view of an alternate embodiment which is configured to suspend the delivery tray above the table surface.
Figure 35:
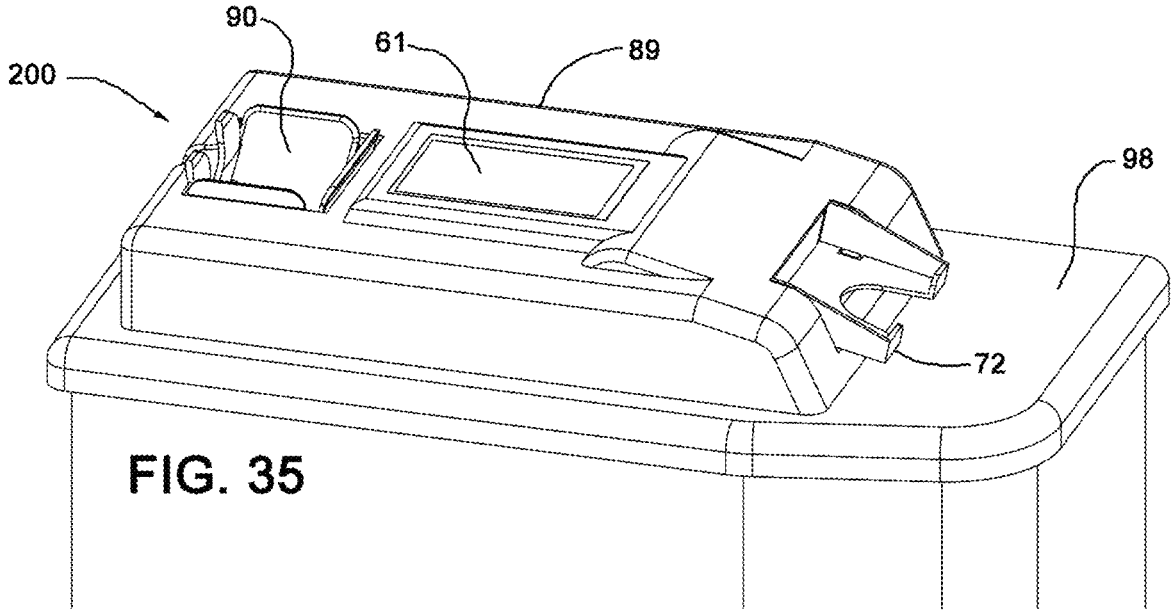
FIG. 35 is an isometric view of the embodiment shown in FIG. 34.

An alternate embodiment of the low profile poker room shuffler is shown in the section view of FIG. 34 as device 200. All of the components of device 200 are the same as device 100 with the exception of bezel 89. Bezel 89 and device mounting surface 99 are configured in device 200 to allow the delivery tray 72 to reside above the table surface in a cantilevered configuration. An isometric view of device 200 is shown in FIG. 35, illustrating the cantilevered delivery tray 72 that is suspended above the table surface 98.

One of ordinary skill, having designer's choice, may choose to utilize different forms of actuators and transport components than those described herein. Other forms of transport components, including cables, gears, chains and other types of belts may be substituted for those described herein. Other types of motors and solenoids are also logical substitutions and other types of sensors may be implemented as is well known in the art. The device may be configured to utilize more or less radially-arranged nests and each nest may be configured to hold more or less cards. Additionally, the capacity of each nest may be altered such that some nests hold a different number of cards without deviating from the invention. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handing device for delivering multiple pre-formed hands for use in a casino card game comprising:

a device upper portion residing above a casino table surface which includes a bezel;

a device lower portion that resides below the casino table surface;

a control panel positioned on an exterior of the bezel;

an unshuffled card input portal consisting of a card receiving cavity within the bezel;

a shuffled card discharge portal consisting of a card delivery tray recessed within a bezel opening and having a support surface configured for receiving substacks of cards that constitute pre-formed hands;

the size of the bezel opening enabling visual and physical access for removal of the pre-formed hands from the card handling device;

the card delivery tray fixedly adjoined to the bezel and configured to repeatedly receive one substack at a time;

a rotatable card receiver having a plurality of radially-arranged card storage nests which rotate about a common axis;

each nest having an exit orifice and an entrance orifice;

each nest configured to hold one substack which constitutes a play-ready hand;

at least one microcontroller responsive to the control panel;

a motor that rotates the card receiver incrementally and bidirectionally amongst the radially-arranged nests while producing centrifugal force;

a card transport that moves cards from the input portal to the rotatable card receiver in the direction of the centrifugal force;

at least one retainer that retains cards within the rotatable card receiver in opposition to centrifugal force;

card substacks within each nest being aligned by the retainer;

wherein the card handing device moves cards into the nests and out of the nests in the same centrifugal force direction;

wherein hands are moved out of the nests at an elevation below the casino table surface;

a slot-less elevator that elevates hands in preparation for transfer to the delivery tray;

wherein the elevator descends to retrieve the next player's hand after each player's hand is retrieved from the delivery tray.

2. The card handling device of claim 1 wherein the card delivery tray resides at an elevation below the casino table surface.

3. The card handling device of claim 1 wherein the bezel protrudes no more than one inch above the casino table surface.

4. The card handling device of claim 1 wherein the card delivery tray resides at an elevation above the casino table surface.

5. The card handling device of claim 1 wherein card substacks are moved from the nests to the elevator by centrifugal force.

6. The card handling device of claim 1 wherein card substacks are moved from the nests to the elevator solely by gravity.

7. The card handling device of claim 1 wherein the entrance orifice of each nest is larger in size than the exit orifice of each nest.

8. The card handling device of claim 1 wherein card substacks are moved to the delivery tray by a downward motion of the slot-less elevator.

9. The card handling device of claim 1 wherein card substacks are removed from the elevator by a stripper mechanism.

10. The card handling device of claim 9, wherein the stripper mechanism includes a pair of support pawls.

11. The card handling device of claim 9, wherein the stripper mechanism is actuated by movement of the slot-less elevator.

12. The card handling device of claim 1 wherein the card delivery tray is suspended within a surrounding cavity within the bezel.

13. The card handling device of claim 1 wherein a first substack may simultaneously reside within the card delivery tray while a second is moving from the rotatable card receiver to the slot-less elevator.

14. The card handling device of claim 1 wherein a first substack may simultaneously reside within the card delivery tray while a second substack resides upon the slot-less elevator.

15. The card handling device of claim 1 that signals an error condition upon card count deviation from a previously programmed parameter.

* * * * *